US007422315B2

(12) United States Patent
Hori

(10) Patent No.: US 7,422,315 B2
(45) Date of Patent: Sep. 9, 2008

(54) LIQUID EJECTION HEAD AND IMAGE FORMING APPARATUS COMPRISING SAME

(75) Inventor: Hisamitsu Hori, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 383 days.

(21) Appl. No.: 11/229,767

(22) Filed: Sep. 20, 2005

(65) Prior Publication Data

US 2006/0061634 A1 Mar. 23, 2006

(30) Foreign Application Priority Data

Sep. 21, 2004 (JP) ..... 2004-273924

(51) Int. Cl.
*B41J 2/045* (2006.01)

(52) U.S. Cl. ..... 347/71; 347/68

(58) Field of Classification Search ..... 347/68, 347/70–72

See application file for complete search history.

(56) References Cited

U.S. PATENT DOCUMENTS

| | | | | |
|---|---|---|---|---|
| 5,574,486 | A * | 11/1996 | Whitlow et al. | 347/45 |
| 5,802,686 | A * | 9/1998 | Shimada et al. | 29/25.35 |
| 5,940,099 | A | 8/1999 | Karlinski | |
| 6,439,702 | B1 | 8/2002 | Karlinski | |
| 6,481,074 | B1 | 11/2002 | Karlinski | |
| 6,616,270 | B1 | 9/2003 | Miyata et al. | |
| 6,766,567 | B2 | 7/2004 | Karlinski | |
| 2003/0088969 | A1 | 5/2003 | Karlinski | |
| 2003/0206218 | A1 | 11/2003 | Miyata et al. | |

FOREIGN PATENT DOCUMENTS

| | | | |
|---|---|---|---|
| JP | 9-226114 | A | 9/1997 |
| JP | 2000-127379 | A | 5/2000 |
| JP | 2000-289201 | A | 10/2000 |
| JP | 2001-179973 | A | 7/2001 |
| JP | 2003-512211 | A | 4/2003 |
| WO | WO-01/30577 | A1 | 5/2001 |

* cited by examiner

*Primary Examiner*—An H Do
(74) *Attorney, Agent, or Firm*—Birch, Stewart, Kolasch & Birch, LLP

(57) ABSTRACT

The liquid ejection head includes a plate having a plurality of ejection ports which eject a liquid, a plurality of pressure chambers which respectively connect to the ejection ports, a plurality of piezoelectric elements which respectively deform the pressure chambers, a plurality of thin plates formed with a plurality of flow channels for the liquid, a common liquid chamber which respectively supplies the liquid to the pressure chambers and a plurality of electric wires which respectively transfer a drive signal to the piezoelectric elements. The piezoelectric elements are provided on a side of the pressure chambers opposite to a side on which the ejection ports are formed and the common liquid chamber is formed in an opposite side to the pressure chambers with respect to the piezoelectric elements The drive signal drive the piezoelectric elements for deforming the pressure chambers, the common liquid chamber is a space which is formed by laminating the thin plates together and the electric wires are formed in opening portions formed in parts of portions on which the laminated thin plates overlap to each other. The electric wires are formed so as to rise upward in a substantially perpendicular direction to a surface on which the piezoelectric elements are disposed.

18 Claims, 23 Drawing Sheets

LIQUID EJECTION HEAD AND IMAGE FORMING APPARATUS COMPRISING SAME

BACKGROUND OF THE INVENTION

1. Field of the Invention

The present invention relates to a liquid ejection head and an image forming apparatus comprising a liquid ejection head, and more particularly to a liquid ejection head and an image forming apparatus comprising a liquid ejection head that an ejection pressure generating unit for ejecting a liquid and a liquid supply unit are formed in a laminated thin plate structure, in order to increase the density of ejection ports which eject the liquid while improving the liquid supply performance.

2. Description of the Related Art

Conventionally, as an image forming apparatus, an inkjet printer (inkjet recording apparatus) is known which comprises an inkjet head (liquid ejection head) having an arrangement of a plurality of nozzles (ejection ports) and which records images on a recording medium by ejecting ink from the nozzles toward the recording medium while causing the inkjet head and the recording medium to move relatively to each other.

In this type of inkjet printer, ink is supplied from an ink tank to a pressure chamber through an ink supply passage. A piezoelectric element is then driven by applying to the piezoelectric element an electric signal corresponding to image data, whereby a diaphragm constituting a part of the pressure chamber is deformed such that the volume of the pressure chamber decreases. As a result, the ink in the pressure chamber is ejected from the nozzle in liquid droplet form.

In the inkjet printer of this kind, the ink is supplied to pressure chambers from an ink tank via an ink supply channel, and piezoelectric elements are driven by supplying electrical signals corresponding to the image data to the piezoelectric elements. Thereby, the diaphragm constituting a portion of each pressure chamber is deformed, the volume of the pressure chamber is deformed, and the ink inside the pressure chamber is ejected from a nozzle in the form of a droplet.

In the inkjet recording printer, one image can be formed on a recording by combining dots formed by ink ejected from the nozzles. In recent years, it has become desirable to form images of high-quality on a par with photographic prints, according to inkjet printers. It has been considered that high image quality can be achieved by reducing the size of the ink droplets ejected from the nozzles by reducing the diameter of the nozzles, while also increasing the number of pixels per image by arranging the nozzles at high density.

Conventionally, various proposals have been made for increasing the density of the nozzle arrangement, and improving the ink supply efficiency so that a higher print speed can be achieved.

For example, it is known that an ink supply channel supplying the ink to a pressure chamber is provided in a diaphragm forming one surface of the pressure chamber while a reservoir (common liquid chamber) is formed on the rear surface of the diaphragm so that ink is supplied from the reservoir to the pressure chamber through the ink supply channel, thereby achieving a high-density nozzle arrangement (see Japanese Patent Application Publication No. 9-226114, for example).

For example, it is also known that a piezoelectric element is provided on the opposite surface of the pressure chamber to the surface in which the nozzle is formed, an ink supply reservoir is disposed on the piezoelectric element side, a cover is provided over the piezoelectric element, and an electrode is extracted by wire bonding or a thin plate, thereby simplifying the structure of the apparatus (see Japanese Patent Application Publication No. 2000-127379, for example).

For example, it is also known that a piezoelectric actuator is disposed on a nozzle face side of a pressure chamber while the inkjet head is formed by Si photoetching so that an aluminum plug passes through laminated layers, thereby achieving a high density and a low cost (see Japanese Patent Application Publication No. 2000-289201, for example).

For example, it is known that a supply restrictor is provided in a diaphragm, an ink supply tank serving as an ink supply unit is provided on the opposite side of a piezoelectric element to a pressure chamber, and an ink supply port connected with the pressure chamber is formed so as to pass through the diaphragm from the ink supply tank. In this case, the ink supply unit functions as an insulating seal for the piezoelectric element, and also functions as a cover for the piezoelectric element and a damper. Therefore, an increase in the number of nozzles, a reduction in cost, and an increase in precision can be achieved (see Japanese Patent Application Publication No. 2001-179973, for example).

For example, it is known that a porous member having a large number of small internally-connected holes, such as a sintered stainless steel, is used as an ink supply layer so as to be able to pass through the ink, in order to realize an inkjet head which has an improvement of refilling, a high print speed, a high confidence, an ability to mix many types of ink, and an excellent filtration property (see Japanese Patent Application Publication No. 2003-512211, for example).

Since a common ink chamber (common liquid chamber) between the piezoelectric element and a power board formed with wiring which supplies drive signals for driving the piezoelectric element are provided in order to shorten the supply and ejection flow channel from the pressure chamber to the nozzle, then it is effective for achieving high-speed printing with a high-viscosity liquid and high-density wire packaging. However, in the case in which the common liquid chamber is disposed on the piezoelectric element side of the pressure chamber as described in Japanese Patent Application Publication Nos. 9-226114 and 2000-127379, for example, if the common liquid chamber is provided on the exterior of the power surface of the piezoelectric element, then the supply flow channel for supplying ink to the pressure chamber increases in length. In particular, when high-viscosity ink is used, the refillability of ink tends to deteriorate. In addition, since the ink supply channel passes through the power surface, then the packaging density is likely to decrease.

Furthermore, when the common liquid chamber is provided on the nozzle side of the pressure chamber as described in Japanese Patent Application Publication No. 2000-289201, for example, the length of the ejection flow channel from the pressure chamber to the nozzle is increased. In particular, when a highly viscous liquid is used, it causes a decrease in responsiveness.

Moreover, the conventional method of forming the pressure chamber and reservoir (common liquid chamber) from silicon causes the cost to increase, and it is difficult to increase length. Additionally, the resin molding has a problem that the finished form, finishing precision, rigidity, and coefficient of linear expansion are insufficient. For example, in Japanese Patent Application Publication No. 9-226114, a silicon photoetching process leads to the increase of cost and the difficulty in elongation of the head. In addition, there is no detailed description of the reservoir or signal circuit connections in Japanese Patent Application Publication No. 9-226114.

In Japanese Patent Application Publication No. 2000-127379, since the reservoir is disposed on a side face, then it is unsuitable for a matrix-form (two-dimensional) nozzle array.

In Japanese Patent Application Publication No. 2001-179973, there is no specific illustration of the construction method for the ink supply unit, and it is difficult to adopt a matrix structure in the illustrated form.

In Japanese Patent Application Publication No. 2003-512211, a bump is formed on both sides of an insulating plate, and then an electrode is taken out by pressurizing the piezoelectric element using an elastic pad. However, it is difficult to achieve increased density, and the connection tends to be unstable.

SUMMARY OF THE INVENTION

The present invention has been designed in consideration of these circumstances, and it is an object thereof to provide a liquid ejection head, and an image forming apparatus comprising the liquid ejection head that can achieve a high density of ejection ports ejecting a liquid while improving the liquid supply performance, so that a highly viscous liquid can be ejected.

In order to attain the aforementioned object, the present invention is directed to a liquid ejection head comprising: a plate having a plurality of ejection ports which eject a liquid; a plurality of pressure chambers which respectively connect to the ejection ports; a plurality of piezoelectric elements which respectively deform the pressure chambers, the piezoelectric elements being provided on a side of the pressure chambers opposite to a side on which the ejection ports are formed; a plurality of thin plates formed with a plurality of flow channels for the liquid; a common liquid chamber which respectively supplies the liquid to the pressure chambers, the common liquid chamber being formed in an opposite side to the pressure chambers with respect to the piezoelectric elements; and a plurality of electric wires which respectively transfer a drive signal to the piezoelectric elements, the drive signal driving the piezoelectric elements for deforming the pressure chambers, wherein: the common liquid chamber is a space which is formed by laminating the thin plates together; and the electric wires are formed in opening portions formed in parts of portions on which the laminated thin plates overlap to each other, the electric wires being formed so as to rise upward in a substantially perpendicular direction to a surface on which the piezoelectric elements are disposed.

According to the present invention, since the liquid ejection head having columnar electric wire (electric column) structures which enable increased nozzle density and high-viscosity liquid ejection, can be constituted as a laminated structure formed by laminating together thin plate members, then a three-dimensional object with a high aspect ratio can be formed easily. Furthermore, it is also possible to enhance the strength of the common liquid chamber formed by this laminated plate structure.

The present invention is also directed to the liquid ejection head wherein a notch structure that the liquid passes through is formed in a part of at least one of the thin plates, the part being between the flow channels. According to the present invention, the spaces between the laminated beam portions, corresponding to the conventional so-called "tributaries", connect through the thin plate members, so that the liquid can be passed through the spaces. Therefore, since the spaces can be formed as the common liquid chamber through all of the print head, it is possible to supply the liquid more efficiently.

The present invention is also directed to the liquid ejection head wherein a mesh structure that the liquid passes through is formed in a part of at least one of the thin plates, the part being between the flow channels. Therefore, since a filter function can be imparted to the laminated plate, it is possible to remove a foreign matter and the like in the liquid flowing between the thin plates.

The present invention is also directed to the liquid ejection head wherein a thin hollow structure is formed in a part of at least one of the thin plates, the part being between the flow channels. Therefore, since a damper function can be imparted to the laminated plate, it is possible to reduce a crosstalk which accompanies liquid backflow during liquid ejection.

The present invention is also directed to the liquid ejection head wherein: the thin plates are laminated together so that beam portions intersect between the thin plates, the beam portions being made by forming the flow channels on each of the thin plates; and the electric wires are formed respectively in parts at which the beam portions intersect. Therefore, the liquid can be supplied more efficiency rather than the notch portion is formed uniformly in a same structure to each of the overlapping parts. Furthermore, since the common liquid chamber is formed through all of the print head, the ink supply performance can be further improved. Moreover, since the refillability of ink is not suppressed by laminating members for enhancing the strength of the common liquid chamber, it is possible to achieve the both improvement of strength and refillability.

The present invention is also directed to the liquid ejection head wherein a thin plate formed with the flow channels is laminated onto the piezoelectric elements, the thin plate having a thin structure in a part corresponding to each of the laminated piezoelectric elements. Therefore, it is possible to the piezoelectric element having a high-rigidity protective structure can be formed at low cost. In addition, since the displacement of the piezoelectric element is not limited, it is possible to ensure stability of the operation.

The present invention is also directed to the liquid ejection head wherein: at least one of recessed form portions and protruding form portions are formed in parts of the thin plates in order to provide the electric wires; and the at least one of the recessed form portions and the protruding form portions make contact with electric connection members.

The present invention is also directed to the liquid ejection head wherein driving inspection is performed to the piezoelectric elements in a state that the liquid is filled in the liquid ejection head before the electric wires are installed on a diaphragm on which the piezoelectric elements are disposed.

According to the present invention, since no material is wasted, a reduction in manufacturing cost can be achieved.

The present invention is also directed to the liquid ejection head wherein: a heater is provided in a part of the laminated thin plates, the heater controlling temperature in the liquid ejection head by heating; and the temperature in the liquid ejection head is controlled by flowing at least the liquid for ejection into the common liquid chamber when the temperature exceeds a set temperature value.

Therefore, the temperature of the liquid ejection head can be controlled evenly.

In order to attain the aforementioned object, the present invention is directed to an image forming apparatus comprising a liquid ejection head which comprises: a plate having a plurality of ejection ports which eject a liquid; a plurality of pressure chambers which respectively connect to the ejection ports; a plurality of piezoelectric elements which respectively deform the pressure chambers, the piezoelectric elements being provided on a side of the pressure chambers opposite to a side on which the ejection ports are formed; a plurality of thin plates formed with a plurality of flow channels for the liquid; a common liquid chamber which respectively supplies the liquid to the pressure chambers, the common liquid chamber being formed in an opposite side to the pressure chambers with respect to the piezoelectric elements; and a plurality of electric wires which respectively transfer a drive signal to the piezoelectric elements, the drive signal driving the piezoelectric elements for deforming the pressure chambers, wherein: the common liquid chamber is a space which is formed by laminating; and the electric wires are formed in opening portions formed in parts of portions on which the laminated thin plates overlap to each other, the electric wires being formed so as to rise upward in a substantially perpendicular direction to a surface on which the piezoelectric elements are disposed.

The present invention is also directed to the image forming apparatus wherein a notch structure that the liquid passes through is formed in a part of at least one of the thin plates, the part being between the flow channels.

The present invention is also directed to the image forming apparatus wherein a mesh structure that the liquid passes through is formed in a part of at least one of the thin plates, the part being between the flow channels.

The present invention is also directed to the image forming apparatus wherein a thin hollow structure is formed in a part of at least one of the thin plates, the part being between the flow channels.

The present invention is also directed to the image forming apparatus wherein: the thin plates are laminated together so that beam portions intersect between the thin plates, the beam portions being made by forming the flow channels on each of the thin plates; and the electric wires are formed respectively in parts at which the beam portions intersect.

The present invention is also directed to the image forming apparatus wherein a thin plate formed with the flow channels is laminated onto the piezoelectric elements, the thin plate having a thin structure in a part corresponding to each of the laminated piezoelectric elements.

The present invention is also directed to the image forming apparatus wherein: at least one of recessed form portions and protruding form portions are formed in parts of the thin plates in order to provide the electric wires; and the at least one of the recessed form portions and the protruding form portions make contact with electric connection members.

The present invention is also directed to the image forming apparatus wherein driving inspection is performed to the piezoelectric elements in a state that the liquid is filled in the liquid ejection head before the electric wires are installed on a diaphragm on which the piezoelectric elements are disposed.

The present invention is also directed to the image forming apparatus wherein: a heater is provided in a part of the laminated thin plates, the heater controlling temperature in the liquid ejection head by heating; and the temperature in the liquid ejection head is controlled by flowing at least the liquid for ejection into the common liquid chamber when the temperature exceeds a set temperature value.

According to the present invention, since high-viscosity liquid can be ejected from the increased-density liquid ejection head, then images with a higher image quality can be formed.

According to the liquid ejection head and image forming apparatus comprising the liquid ejection head of the present invention, as described above, the liquid ejection head, which comprises columnar electric wire (electric column) structures enabling increased nozzle density and high-viscosity liquid ejection, may be constituted as a laminated structure formed by laminating together thin plate members. Furthermore, the strength of the common liquid chamber formed by this laminated structure can be enhanced.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 16B is an enlarged view of a part C in FIG. 16A;

DETAILED DESCRIPTION OF THE PREFERRED EMBODIMENTS

Figure 1:
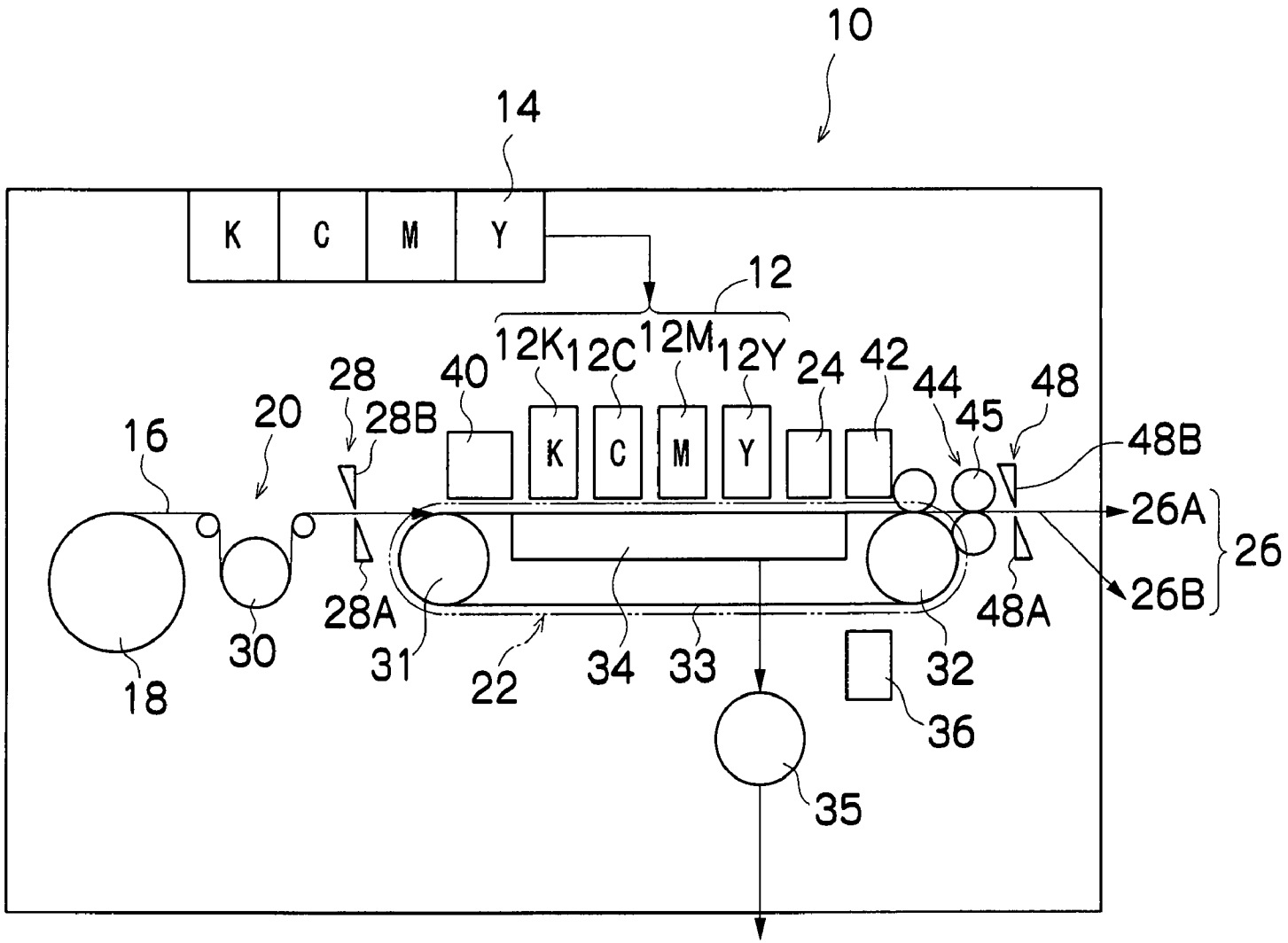
FIG. 1 is a general schematic drawing of an inkjet recording apparatus as an image forming apparatus comprising a liquid ejection head according to a first embodiment of the present invention.

FIG. 1 is a general schematic drawing of an inkjet recording apparatus as an image forming apparatus comprising a liquid ejection head according to a first embodiment of the present invention.

As shown in FIG. 1, an inkjet recording apparatus 10 comprises: a printing unit 12 having a plurality of print heads (liquid ejection heads) 12K, 12C, 12M, and 12Y provided for each ink color; an ink storing and loading unit 14 in which the ink supplied to the print heads 12K, 12C, 12M, and 12Y is stored; a paper supply unit 18 which supplies a recording paper 16; a decurling unit 20 which removes curls from the recording paper 16; a suction belt conveyance unit 22 disposed opposite a nozzle face (ink ejection face) of the printing unit 12 for conveying the recording paper 16 while maintaining the flatness of the recording paper 16; and a paper output unit 26 which outputs the printed recording paper (printed object) to the outside.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of an apparatus constitution using rolled paper, as shown in FIG. 1, a cutter 28 is provided, and the rolled paper is cut into the desired size by this cutter 28. The cutter 28 is constituted by a stationary blade 28A having a length which is equal to or greater than the width of the conveyance path for the recording paper 16, and a round blade 28B which moves along the stationary blade 28A. The stationary blade 28A is provided on the rear side of the print surface, and the round blade 28B is disposed on the print surface side so as to sandwich the conveyance path together with the stationary blade 28A. Note that when cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 is structured such that an endless belt 33 is wrapped around rollers 31 and 32 so that the part of the endless belt 33 facing at least the nozzle face of the printing unit 12 forms a horizontal plane (flat plane).

The belt 33 has a width that is greater than the width of the recording paper 16, and a plurality of suction openings (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 when the motive force of a motor (not shown) is transmitted to at least one of the rollers 31 and 32 around which the belt 33 is wrapped, and thus the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 forms a so-called full-line head (see FIG. 2) in which line heads having a length which corresponds to the maximum paper width are disposed in an orthogonal direction (main scanning direction) to the paper conveyance direction (sub-scanning direction).

Figure 2:
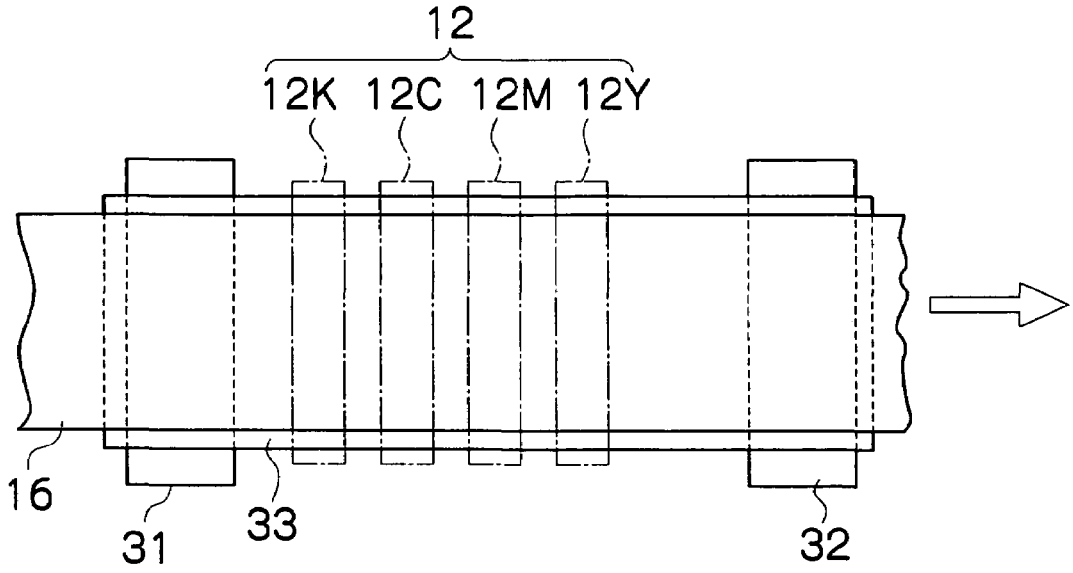
FIG. 2 is a principal plan view of principal components of an area around a printing unit in the inkjet recording apparatus shown in FIG. 1.

As shown in FIG. 2, each of the print heads 12K, 12C, 12M, and 12Y is configured as a line head in which the plurality of ink discharge ports (nozzles) are arranged in the lengthwise direction of the print heads 12K, 12C, 12M, and 12Y over a length which exceeds at least one side of the maximum size recording paper 16 used in the inkjet recording apparatus 10.

The print heads 12K, 12C, 12M, and 12Y corresponding to each ink color are disposed in order of black (K), cyan (C), magenta (M), and yellow (Y) from the upstream side (the left side in FIG. 1) in the conveyance direction (paper conveyance direction) of the recording paper 16. A color image can be formed on the recording paper 16 by depositing colored ink thereon from the respective print heads 12K, 12C, 12M, and 12Y while conveying the recording paper 16.

The printing unit 12, in which the full-line heads covering the entire width of the paper are thus provided for the respective ink colors, can record an image over the entire surface of the recording paper 16 by performing the action of moving the recording paper 16 and the printing unit 12 relatively to each other in the paper conveyance direction (sub-scanning direction) just once (in other words, by means of a single sub-scan). Higher-speed printing is thereby made possible and productivity can be improved in comparison with a shuttle type head in which a recording head moves reciprocally in the direction (main scanning direction) perpendicular to the paper conveyance direction (sub-scanning direction).

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the ink storing and loading unit 14 comprises tanks storing colored ink corresponding to each print head 12K, 12C, 12M, and 12Y. Each tank communicates with the print head 12K, 12C, 12M, and 12Y via a pipe not shown in the drawing. The ink storing and loading unit 14 further comprises a notification device (a display device, warning sound generating device or the like) for providing notification of a low remaining ink amount, and a mechanism for preventing situations in which the wrong ink color is loaded.

A post-drying unit 42 is disposed following the print heads 12K, 12C, 12M, and 12Y. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target image is provided with a sorter for collecting images according to print orders.

Figure 3:
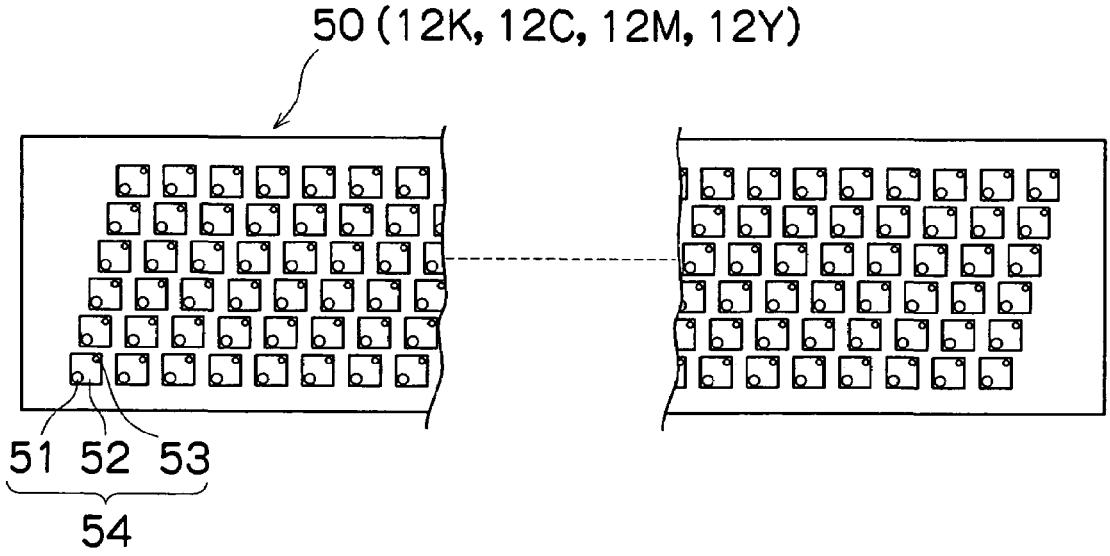
FIG. 3 is a perspective plan view showing an example of composition of a print head.

Next, the nozzle (liquid ejection port) arrangement in the print head (liquid ejection head) will be described. The print heads 12K, 12C, 12M, and 12Y provided for each ink color have a same structure, and a reference numeral 50 is hereinafter designated to any of the print heads. FIG. 3 is a perspective plan view showing an example of the composition of a print head 50.

As shown in FIG. 3, in the print head 50 according to the present embodiment, a plurality of pressure chamber units 54 respectively constituted by a nozzle 51 which ejects ink in the form of liquid droplets, a pressure chamber 52 which applies pressure to the ink during ink ejection, and an ink supply port 53 which supplies ink to the pressure chamber 52 through a common flow channel (not shown in FIG. 3), are arranged in a two-dimensional, staggered matrix form so that the nozzles 51 are provided at a high density.

In the example shown in FIG. 3, each of the pressure chambers 52 takes a substantially square planar form when seen from above, although the planar form of the pressure chamber 52 is not limited to a square shape. As shown in FIG. 3, the nozzle 51 is formed at one end of the diagonal of the pressure chamber 52, and the ink supply port 53 is provided at the other end.

Figure 4:
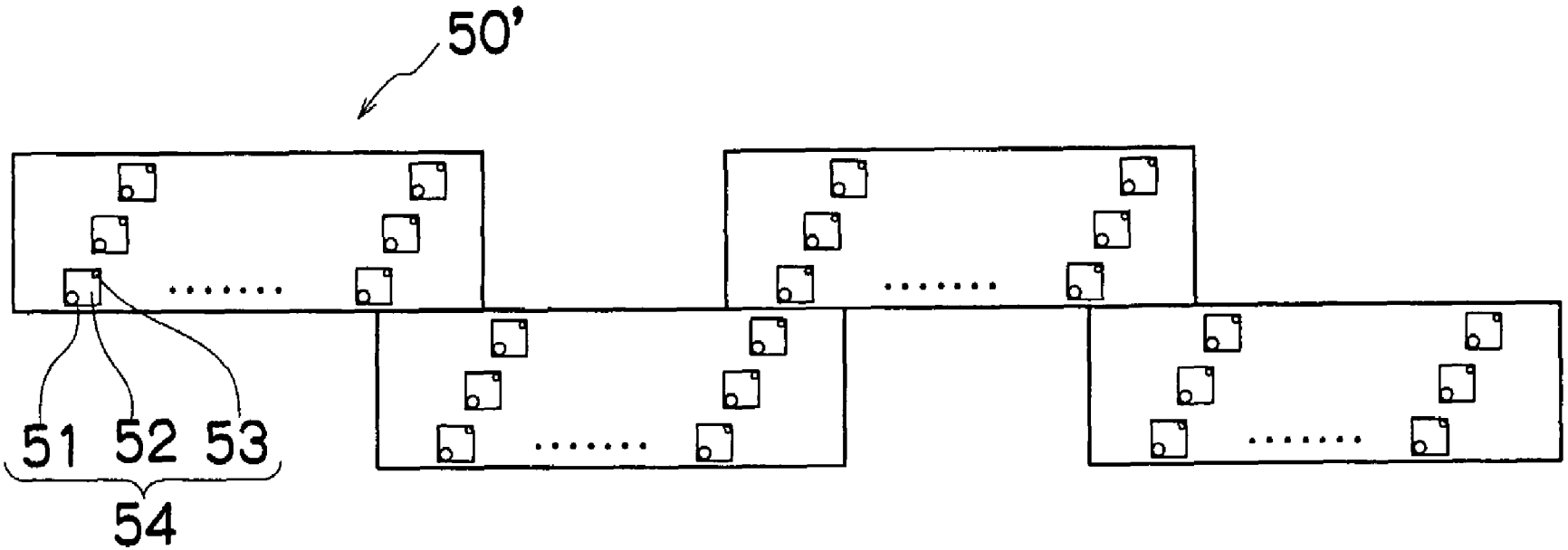
FIG. 4 is a perspective plan view showing another example of composition of the print head.

FIG. 4 is a perspective plan view showing another example of another print head. As shown in FIG. 4, a full-line head can be composed of a plurality of short two-dimensionally arrayed head units 50' arranged in the form of a staggered matrix and combined so as to form nozzle rows having lengths that correspond to the entire width of the recording paper 16.

Figure 5:
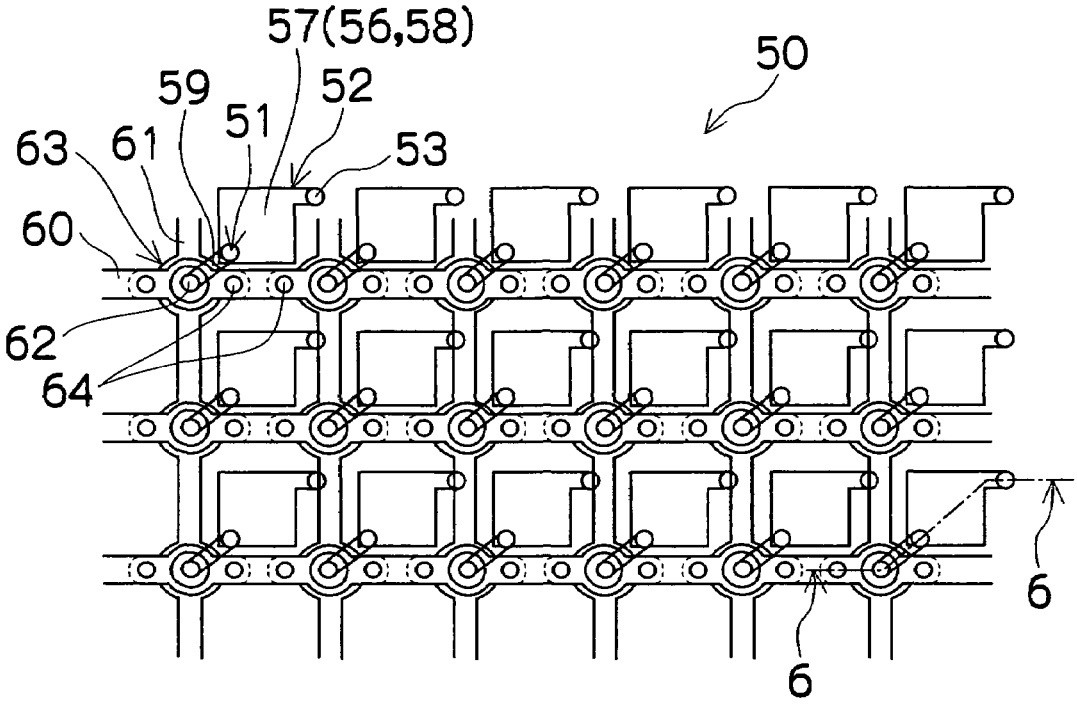
FIG. 5 is a partially enlarged perspective plan view of the print head according to the first embodiment.

FIG. 5 is a partially enlarged perspective plan view the print head 50 according to this embodiment.

Hereinafter, the print head 50 according to the present embodiment is formed by laminating a large number of various types of plate members.

As described above, the substantially square-shaped pressure chambers 52 comprising the nozzle 51 and the supply port 53 are arranged in the two-dimensionally arrayed print head 50 in the form of a staggered matrix. An upper face of the pressure chamber 52 opposing to the lower face formed with the nozzle 51 is constituted by a diaphragm 56 which doubles as a common electrode. A piezoelectric body (piezo) 58 is formed on the diaphragm 56 in a form which corresponds to the form of the pressure chamber 52, and an individual electrode 57 is formed on the piezoelectric body 58. A wire is drawn out from the individual electrode 57 to the outside of the pressure chamber 52 from the side end portion of the nozzle 51, so as to form an electrode pad 59 as an electrode connection portion.

A columnar electric wire (electric column) 62 is formed substantially perpendicular to the piezo 58 so as to rise upward from the electrode pad 59. In order to form the columnar electric wire 62, a thin plate-formed first wiring plate 60 and a thin plate-formed second wiring plate 61 are laminated together alternately so that the respective beam portions of the first and second wiring plates 60 and 61 are orthogonal to each other, thereby producing a matrix form. The first wiring plate 60 forms with flow channels so as to have a plurality of beam portions constituted by a plurality of strip-form plates which are connected at both ends in the horizontal direction. Similarly, the second wiring plate 61 forms with flow channels so as to comprise a plurality of beam portions constituted by a plurality of strip-form plates which are connected at both ends in the vertical direction. At this time, the elongated beam portions of the wiring plates 60 and 61 are laminated so as to be disposed in the parts between each pressure chamber 52. The electric wires 62 are formed in overlapping parts 63 which are formed by intersecting and overlapping beam portions of the first and second wiring plates 60 and 61 which are laminated each other.

Each of the overlapping parts 63 is also formed with a sensor column 64 which is a wire which picks up a determination signal from a sensor plate (not shown in FIG. 5, to be described below) as a pressure measuring device which determines the state of pressure generation inside the pressure chamber 52. Similarly to the electric wire 62, the sensor column 64 is formed in a columnar form which rises upward substantially perpendicular to the piezoelectric body 58.

Figure 6:
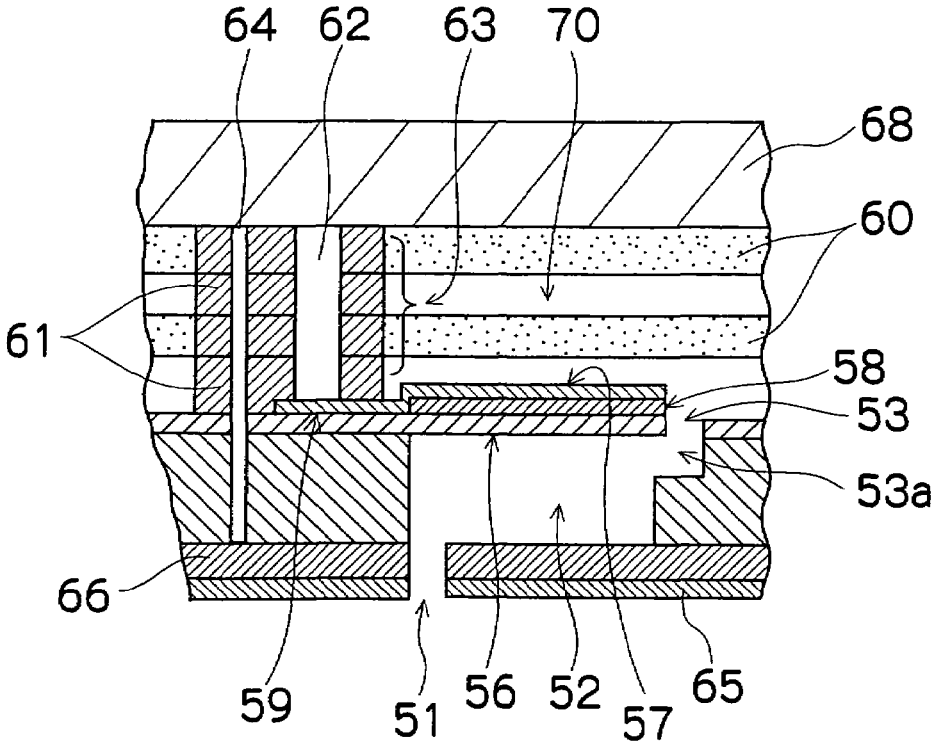
FIG. 6 is a sectional view along a line 6-6 in FIG. 5.

For more detail description of the constitution described above, a sectional view along a line 6-6 in FIG. 5 is shown in FIG. 6. As shown in FIG. 6, the pressure chamber 52 is provided the nozzle 51 on the end portion of lower face of the pressure chamber 52, and the supply port 53 on the end portion of upper face thereof (namely, on the opposite side to the nozzle 51 side). A supply restrictor 53*a* which restricts ink backflow during ink ejection is provided in the supply port 53.

As described above, the upper face of the pressure chamber 52 is formed by the diaphragm 56 which doubles as a common electrode. The piezo 58 is formed on the diaphragm 56, and the individual electrode 57 is formed on the piezo 58. The end portion of the individual electrode 57 is drawn out from the pressure chamber 52 as a wire, thereby forming the electrode pad 59. Although not shown in the drawing, an insulation layer is formed between the diaphragm 56 and electrode pad 59.

A sensor plate 66 which determines defective ejection by measuring the pressure generated within the pressure chamber 52 is formed on the lower face of the pressure chamber 52. A nozzle plate 65, in which the nozzle 51 is formed, is joined to the lower side of the sensor plate 66. The sensor plate 66 is constituted by a piezoelectric body serving as a mechano-electric conversion element. The sensor column 64 is an electric wire for extracting as an electric signal voltage change produced when the sensor plate 66 is deformed through pressure application. Although only one sensor column 64 is shown in FIG. 6, the sensor column 64 extends in reality from both the front and rear of the sensor plate 66, which is constituted by a piezoelectric body serving as a mechano-electric conversion element, thereby providing two sensor columns 64 for the respective pressure chambers 52.

The columnar electric wire (electric column) 62 is disposed upright on each electrode pad 59 substantially perpendicular to the piezo 58. In order to form the columnar electric wire 62, the first wiring plate 60 formed in the horizontal direction and the second wiring plate 61 formed in the vertical direction are alternately orthogonal to each other so that the respective beam portions of the first and second wiring plates 60 and 61 are positioned in the parts between the pressure chambers 52, thereby forming in a matrix form. Then, the columnar electric wires 62 and sensor columns 64 are formed at matrix overlapping parts 63 in which the first wiring plate 60 and the second wiring plate 61 intersect and overlap.

A multi-layer flexible cable 68 as a power board is disposed on the laminated first wiring plate 60 and second wiring plate 61. The electric wires 62 and sensor columns 64 are connected to the multi-layer flexible cable 68.

In this case, the first and second wiring plates 60 and 61 are laminated so that the respective beam portions thereof are disposed between the respective pressure chambers 52, and therefore a space is formed in the part above the pressure chambers 52. The space is formed by laminating the thin plates (first and second wiring plates 60 and 61) having flow channels between the beam portions, and then serves as a common liquid chamber (reservoir) 70 which accommodates the ink supplied to the respective pressure chambers 52. As regards the common liquid chamber 70, since the first and second wiring plates 60 and 61 are laminated alternately, the space between the beam portions thereof forms an empty flow channel. Therefore, since the spaces above all of the pressure chambers 52 are connected to each other, a single common liquid chamber 70 is formed through all of the print head 50.

Incidentally, since the common liquid chamber 70 is filled with ink, all of the parts making contact with the ink are covered with an insulation and protection film.

Figure 7A:
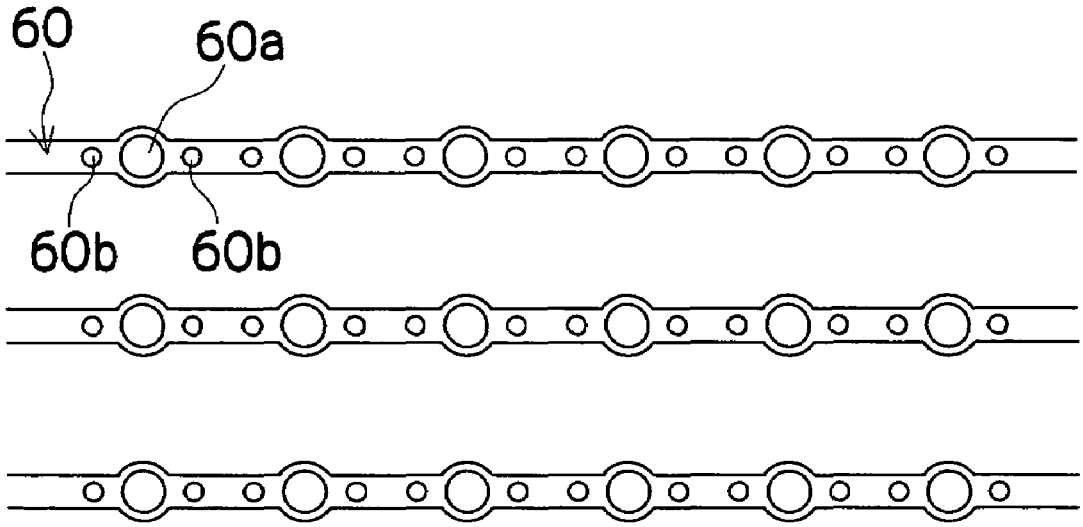
FIGS. 7A and 7B are plan views of a wiring plate according to the first embodiment.
Figure 7B:
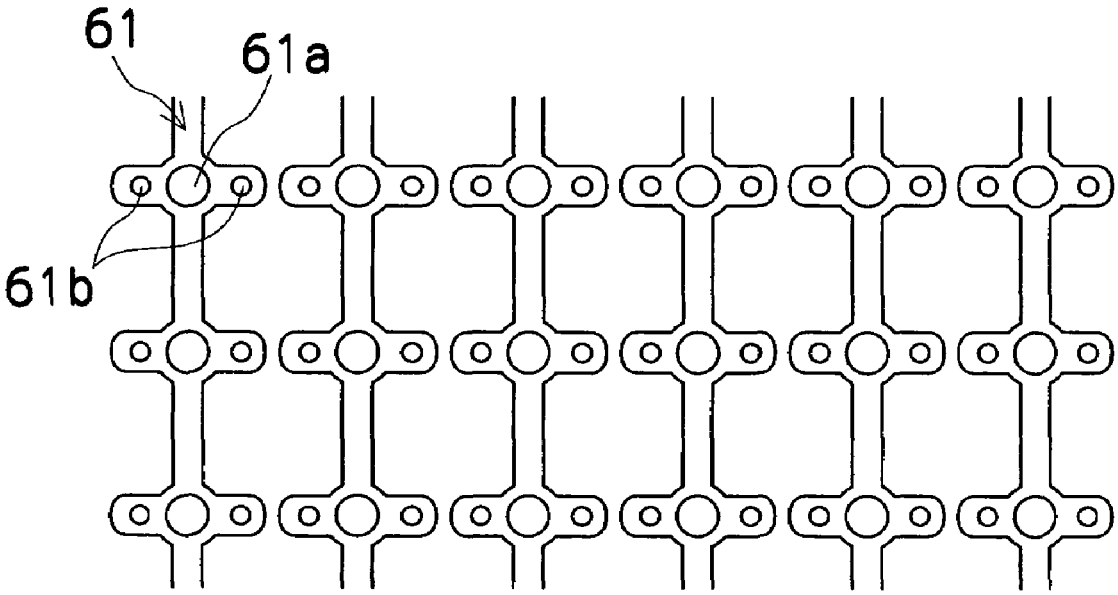

FIGS. 7A and 7B are plan views showing the first and second wiring plates 60 and 61, respectively. As shown in FIG. 7A, the first wiring plate 60 is formed with a plurality of electric wire holes 60*a* for forming the electric wires 62, and the electric wire holes 60*a* are arranged in series at equal intervals in the beam portions formed in an elongated strip form in the horizontal direction. The parts forming the electric wire holes 60*a* in the beam portions have an expanded outer dimension corresponding to the form of the electric wire hole 60*a*. A sensor column hole 60*b* for forming the sensor column 64 is formed on each side of the electric wire hole 60*a*.

As shown in FIG. 7B, the second wiring plate 61 is formed with a plurality of electric wire holes 61*a* for forming the electric wires 62, and the electric wire holes 61*a* are arranged in series at equal intervals in the beam portions formed in an elongated strip form in the vertical direction. A sensor column hole 61*b* for forming the sensor column 64 is formed on each side of the electric wire hole 61*a*. The parts forming the electric wire holes 61*a* in the second wiring plate 61 is formed in a cross form so as to include the sensor column holes 61*b* on each side of the electric wire hole 61*a*.

The respective elongated strip-formed beam portions of the wiring plates 60 and 61 are connected at both ends to form respective single plates. By laminating the first and second wiring plate 60 and 61 alternately so that the respective beam portions thereof intersect with the respective aligned electric wire holes 60*a* and 61*a*, a plurality of cavity portions (through holes) for forming the electric wires 62 and sensor columns 64 are formed perpendicular to the wiring plates 60 and 61 in the matrix overlapping parts 63 (see FIG. 6) at which the beam portions intersect and overlap.

Figure 8:
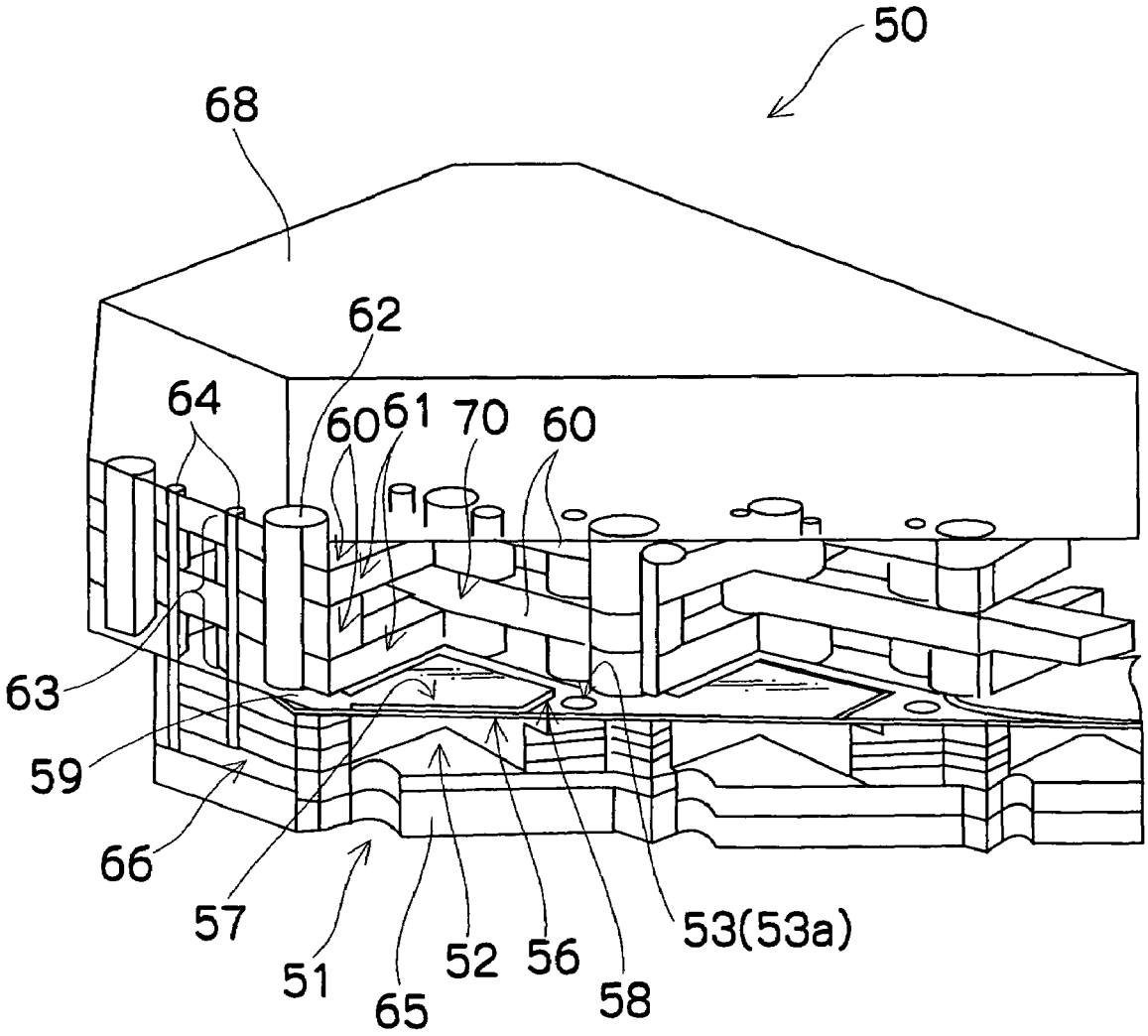
FIG. 8 is a perspective diagram of the print head according to the first embodiment, including a partially enlarged cross-section thereof.

FIG. 8 a perspective view of the print head 50 according to this embodiment, including a partial cross-section, showing the print head 50 formed by laminating the various plate members described above.

As shown in FIG. 8, the print head 50 is formed the nozzle plate 65 having the nozzle 51 at the lowest layer, the sensor plate 66 is formed on the nozzle plate 65, and several plate members are laminated on the sensor plate 66 to form the pressure chamber 52.

The diaphragm 56 is formed on the upper face of the pressure chamber 52, and the piezo 58 and individual electrode 57 are formed on the diaphragm 56. The elongated strip-formed beam portions of the first and second wiring plates 60 and 61 are laminated alternately above the diaphragm 56 in the parts between the pressure chambers 52 arranged in a two-dimensional matrix form, and hence the common liquid chamber 70 is formed above the diaphragm 56. The common liquid chamber 70 and the pressure chamber 52 are connected by the supply port 53 (supply restrictor 53*a*) formed in the diaphragm 56.

When laminating the first and second wiring plates 60 and 61, the parts of the electric wire holes 60*a* and 61*a* formed in both wiring plates 60 and 61 overlap in the matrix overlapping parts 63 at which the beam portions intersect and overlap, thereby forming a plurality of cavity portions (through holes) which are perpendicular to the piezo 58. Similarly, the cavity portions (through holes) which are perpendicular to the piezo 58 are also formed in the parts in which the sensor column holes 60*b* and 61*b* overlap.

Those cavity portions (through holes) are plated and filled with a conductive material, so that the columnar electric wires (electric columns) 62 and sensor columns 64 are formed perpendicular to the piezo 58.

Furthermore, the multi-layer flexible cable 68 is formed at the uppermost layer, so that the electric wires 62 and the sensor columns 64 are connected to wiring inside the multi-layer flexible cable 68. The electric wires 62 and the sensor columns 64 respectively provided in substantially perpendicular direction to the piezo 58 (or the diaphragm 56 or the like formed with the piezo 58) so that the electric wires 62 respectively connect the electrode pad 59 drawn out from the individual electrode 57 on the diaphragm 56 to the multi-layer flexible cable 68 while the sensor columns 64 respectively connect the sensor plate 66, which forms the bottom face of the pressure chamber 52, to the multi-layer flexible cable 68.

In this way, according to this embodiment, layers of the laminated wiring plates 60 and 61 for forming the columnar electric wires (electric columns) 62 are disposed in matrix form, and therefore the spaces formed above the respective pressure chambers 52 by the beam portions laminated alternately to form a matrix form are connected, thereby forming a flow channel through which ink can flow. Those spaces constitute a common liquid chamber which is connected through all of the print head 50. Therefore, since the ink is supplied from the common liquid chamber directly to the pressure chamber 52 through the ink supply port (supply restrictor) 53, it is possible to improve the ink supply performance, while the strength of the common liquid chamber can be ensured.

Furthermore, not only the electric wires (electric columns) 62, but also the sensor columns 64 for energizing the sensing unit are constituted by a thin-film laminated structure, and therefore a large number of electrodes can be provided at high density and in a small area.

Next, a second embodiment of the present invention will be described.

Figure 9:
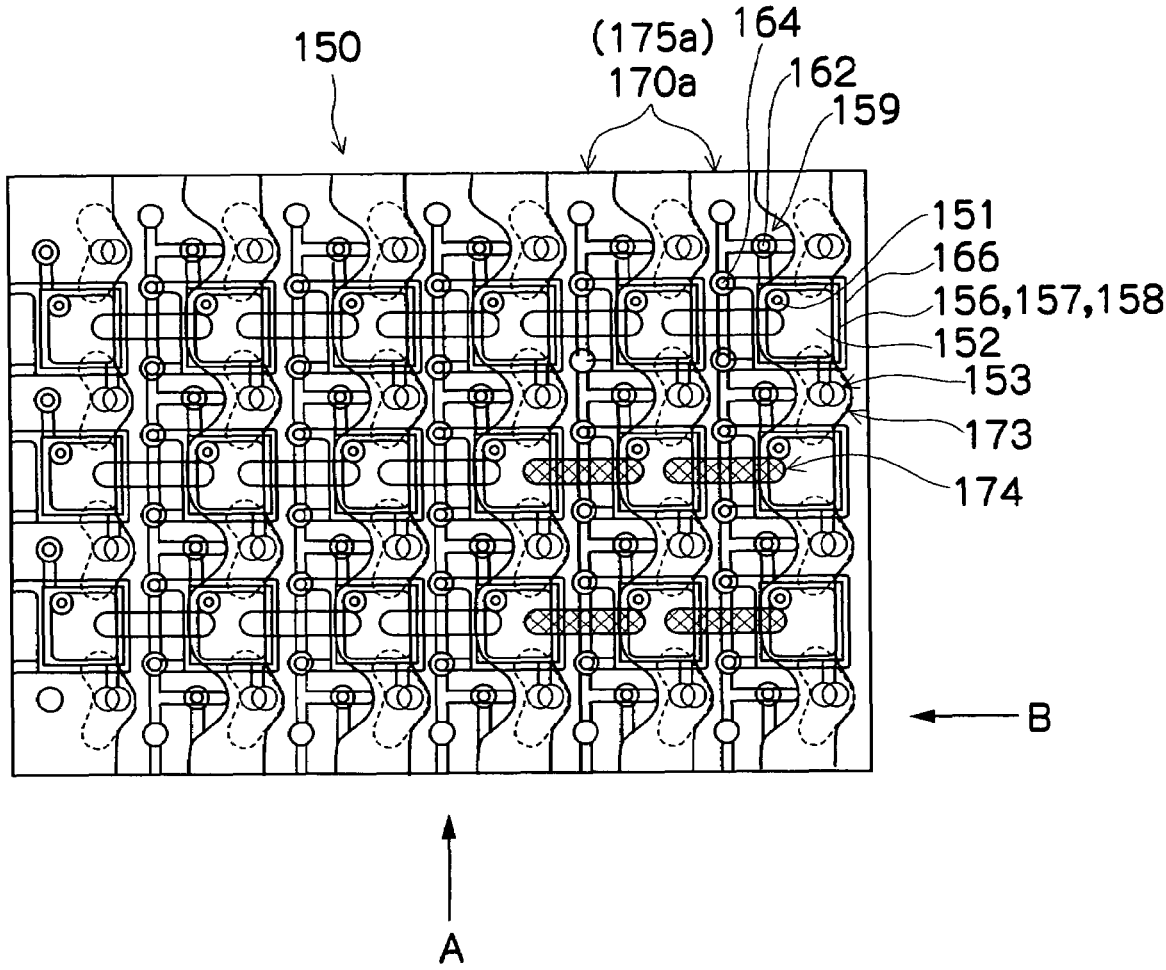
FIG. 9 is a perspective plan view of a print head according to a second embodiment of the present invention.
Figure 10A:
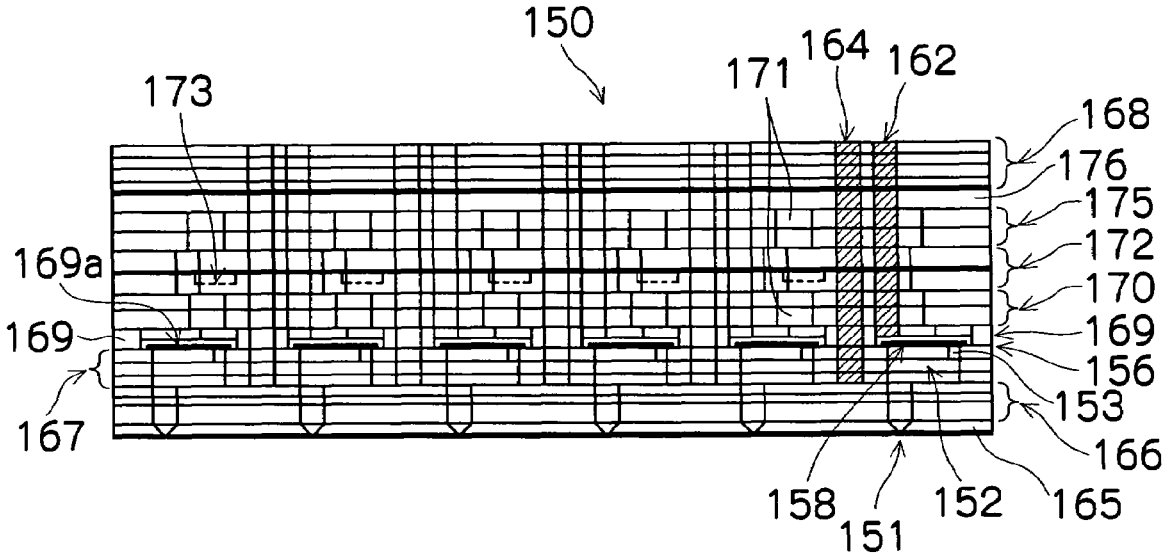
FIGS. 10A and 10B are perspective side views of the print head according to the second embodiment, FIG. 10A being a view when seen from a direction of an arrow A in FIG. 9, and FIG. 10B being a view when seen from a direction of an arrow B in FIG. 9.
Figure 10B:
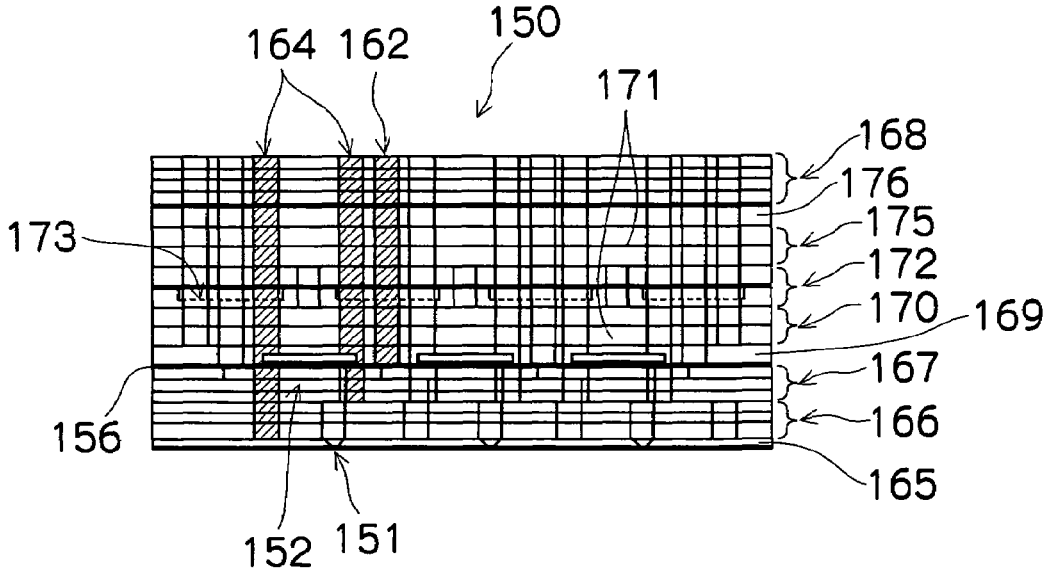

FIG. 9 shows a perspective plan view of a print head 150 according to the second embodiment. FIG. 10A shows a perspective side view of the print head 150 when seen from the direction of an arrow A in FIG. 9, and FIG. 10B shows a perspective side view of the print head 150 when seen from the direction of an arrow B in FIG. 9. FIGS. 11 and 12 are exploded plan views of the respective plate members in the print head 150.

In the present. embodiment, a plurality of thin plates in which a plurality of flow channels are formed by elongated beam portions are also laminated together, so that the columnar electric wires (electric columns) are formed. A filtering and damping layer is provided in a part of the laminated layers, which has mesh serving as a filter, and a void serving as a damper. The spaces formed by the laminated beam portions are connected so that the ink can flow through, thereby forming a common liquid chamber connected through all of the print head 150.

FIG. 9 is a perspective plan view of a print head 150 formed by laminating all of the plate members shown in FIGS. 11 and 12 to each other. As similar to the first embodiment described above, substantially square pressure chambers 152 are arranged in a staggered two-dimensional matrix form.

The pressure chamber 152 comprises: a supply port (supply restrictor) 153; a nozzle 151; a columnar electric wire (electric column) 162 which supplies a drive signal to an individual electrode 157; and an electric wire sensor column 164 which transmits a determination signal from a piezoelectric body of a sensor plate 166 which determines defective ejection.

The present embodiment is similar to the first embodiment that the columnar electric wire 162 and sensor column 164 are formed while a plurality of wiring plates 170 are laminated together above a diaphragm 156 so as to form a space as a common liquid chamber. However, the form of the wiring plate 170 according to the present embodiment differs from that of the first embodiment shown in FIGS. 7A and 7B. Moreover, in the present embodiment, the filtering and damping layer is formed between the laminated wiring plates 170, as described below.

Hereinafter, the various laminated plate members and a method of laminating those plate members will be described.

Firstly, as shown in FIGS. 10A and 10B, a nozzle plate 165 formed with the nozzle 151 is placed on the lowest layer. The nozzle plate 165 is shown in the plan view of FIG. 11A. For example, the nozzle plate 165 is formed by half-cut pressing and polishing a stainless steel thin plate, or is formed by nickel-electroforming, or is formed by implementing liquid repellency processing on a substance, such as a polyimide that abrasion processing is implemented by using an excimer laser. The nozzle 151 is formed in a reverse tapered form so that the diameter of the nozzle 151 decreases steadily toward the ink ejection side (outside).

Figure 11A:
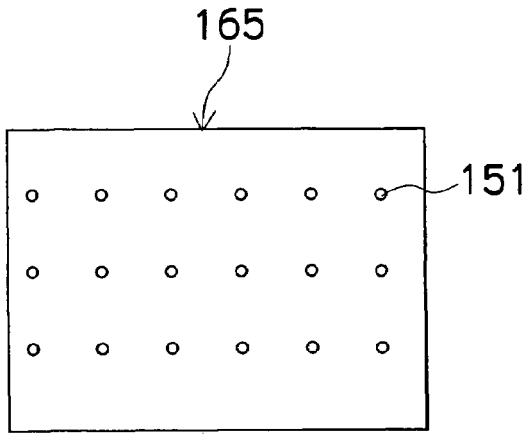
FIGS. 11A to 11E are plan views of plate members in the print head according to the second embodiment, FIG. 11A showing a nozzle plate, FIG. 11B showing a sensor plate, FIG. 11C showing a pressure chamber plate, FIG. 11D showing a diaphragm (plate), and FIG. 11E showing a piezo cover.
Figure 11B:
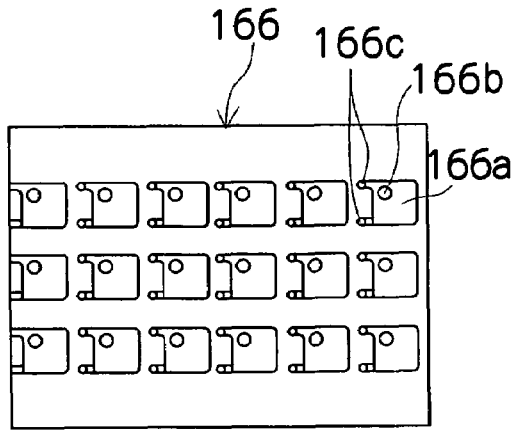

Next, as shown in FIGS. 10A and 10B, a sensor plate 166 which determines the pressure inside the pressure chamber 152 is formed on the nozzle plate 165. The sensor plate 166 is shown in the plan view in FIG. 11B. The sensor plate 166 is formed by coating stainless steel with PVDF (polyvinylidene fluoride), for example. As shown in FIG. 11B, a sensor unit 166*a* is formed on the sensor plate 166 substantially among the form of the pressure chamber 152. A hole 166*b* as a nozzle flow channel is provided in a position corresponding to the nozzle 151, and two connection portions 166*c* are formed by drawing out wires from the front and rear of the sensor unit 166*a*, respectively.

Next, as shown in FIGS. 10A and 10B, a pressure chamber plate 167 which forms the pressure chamber 152 is laminated onto the sensor plate 166. The pressure chamber plate 167 is formed by subjecting stainless steel plates to multi-step etching or double-sided etching, and then laminating the etched stainless steel plates, for example.

Figure 11C:
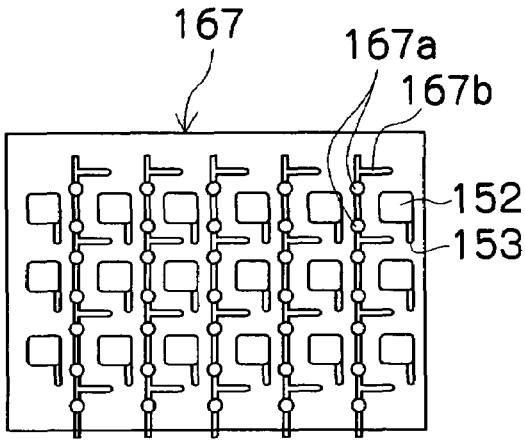

The pressure chamber plate 167 is shown in the plan view in FIG. 11C. The pressure chamber plate 167 comprises: the pressure chamber 152; an opening as a supply restrictor 153; a hole (through hole) 167*a* for the sensor column 164; an adhesive escape groove 167*b* for allowing excess adhesive to escape in order to prevent the run-out adhesive from blocking the pressure chamber 152 or the supply restrictor 153 during adhesion; and so on. Incidentally, the through hole 167*a* may be used as the adhesive escape groove.

The pressure chamber plates 167 may be joined by epoxy adhesion, diffusion bonding, or a similar process, for example. Furthermore, insulation processing is implemented on the pressure chamber plate 167 by a processing, such as a polyimide deposition processing or an electrode position processing, and electroless copper plating or the like is implemented on the inside of the sensor column through holes 167*a* in order to form a conductive layer. Then, a filling material such as silver paste is filled into the sensor column through holes 167*a* in order to form a connection with the connection portions 166*c* of the sensor plate 166.

Figure 11D:
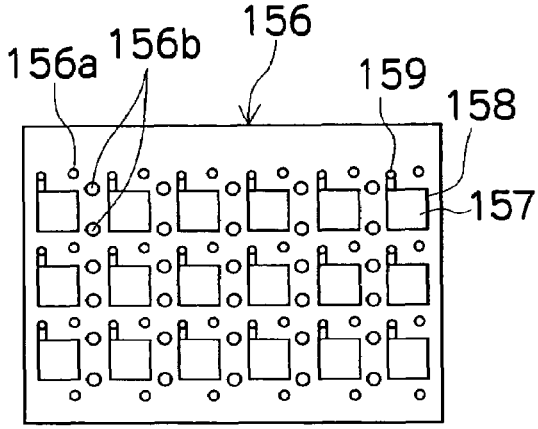

Next, as shown in FIGS. 10A and 10B, the diaphragm 156 is laminated onto the pressure chamber plate 167 by epoxy adhesion or the like. Then, as shown in FIG. 11D, a piezo (PZT) 158 is formed on the diaphragm 156 in a position corresponding to the pressure chamber 152. The piezo 158 is formed by mechanically separating a fired and polished plate on which a common electrode is formed by sputtering. Furthermore, as shown in FIG. 11D, a hole 156*a* for the supply restrictor 153 and a hole 156*b* for the sensor column 164 are formed in the diaphragm 156, the individual electrode 157 is formed on the piezo 158, and an electrode pad 159 is drawn out the individual electrode 157 onto an insulation layer.

Figure 11E:
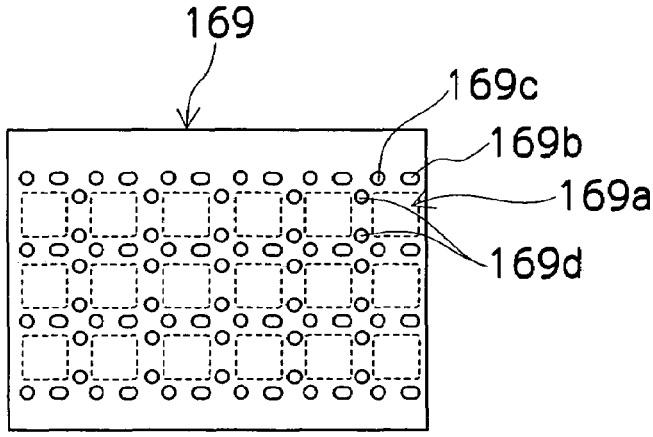

Next, as shown in FIGS. 10A and 10B, a piezo cover 169 is laminated onto the diaphragm 156 formed with the piezo 158. The piezo cover is shown in the plan view in FIG. 11E. For example, the piezo cover 169 has a half-cut structure produced by subjecting a stainless steel thin plate to wet etching, and by subjecting a part 169*a* corresponding to the position of the piezo 158 to half-etching, so as to prevent from making contact with the piezo 158 when laminating. Furthermore, as shown in FIG. 11E, a hole 169*b* forming the supply port, an electric wire hole 169*c*, and a sensor column hole 169*d* are formed in the piezo cover 169. As similar to the pressure chamber plate 167, insulation processing is implemented, a conductive layer is formed on the inside of the holes, and a filling material is filled therein.

Incidentally, the reasons for performing half-etching on the part 169*a* corresponding to the position of the piezo 158 are to protect the piezo 158 from ink by covering the piezo 158, to stabilize driving of the piezo 158 in isolation from the ink, and to reduce crosstalk by providing a damping characteristic.

Next, as shown in FIGS. 10A and 10B, the wiring plates (common liquid chamber plates) 170 are laminated onto the piezo cover 169, so that the cavity portions are formed for the columnar electric wires 162 and sensor columns 164 while the space is also formed for the common liquid chamber. The wiring plate 170 is formed by subjecting a stainless steel thin plate to wet etching, for example. The wiring plate 170 is shown in the plan view in FIG. 12A. The wiring plate 170 is formed in a single plate form by arranging a large number of elongated strip-form beam portions 170*a* in series and connecting the beam portions 170*a* at both ends (at the top and bottom in the drawing). Following lamination of the wiring plates 170, a space 171 between the beam portions 170*a* becomes a space as a common liquid chamber. The wiring plate 170 is also formed with electric wire holes (through holes) 170*b* and sensor column holes (through holes) 170*c* in the respective beam portions 170*a*.

Next, as shown in FIGS. 10A and 10B, a filtering and damping plate 172 is laminated onto the wiring plate 170. The filtering and damping plate 172 is formed by subjecting a stainless steel thin plate to wet etching, for example. Two filtering and damping plates 172 are laminated together in order to form a filtering and damping layer.

Figure 12A:
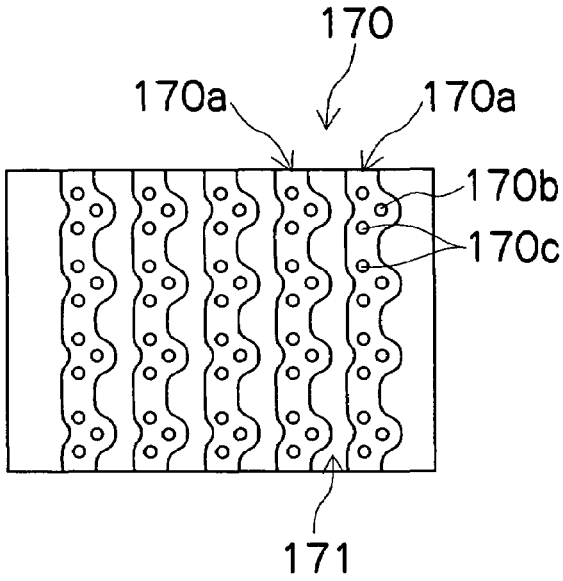
FIGS. 12A to 12D are plan views of plate members in the print head according to the second embodiment, FIGS. 12A and 12C showing a wiring plate (common liquid chamber plate), FIG. 12B showing a filtering and damping plate, and FIG. 12D showing a heater layer.
Figure 12B:
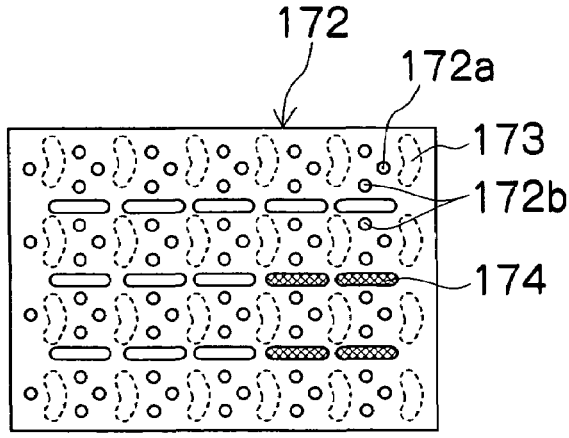
Figure 12C:
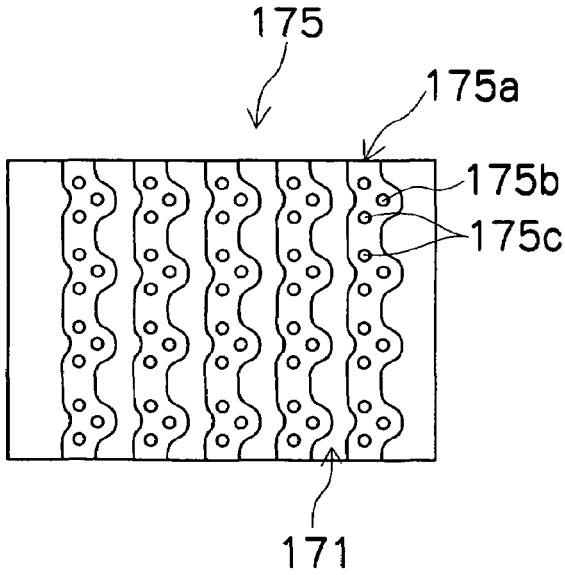
Figure 12D:
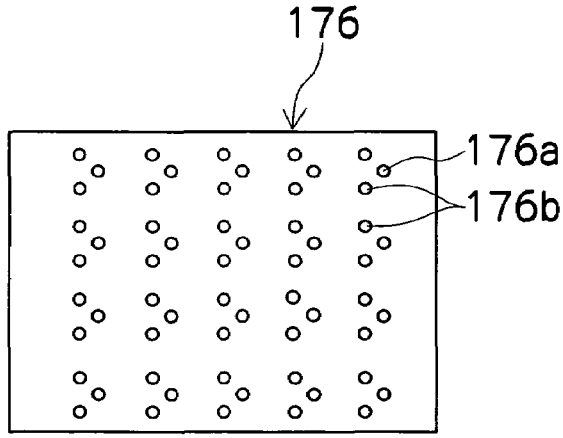

The filtering and damping layer has a filter and a damper formed between the two filtering and damping plates 172. The filtering and damping plate 172 is shown in the plan view in FIG. 12B. As shown in FIG. 12B, an arc-shaped damper 173 is formed by half-etching at a position corresponding to the supply restrictor 153 in the filtering and damping plate 172. Furthermore, an opening is formed at the positions corresponding to the respective beam portions 170*a* in the wiring plate 170 so that the spaces 171 on each side of the beam portions 170*a* is connected to each other, and then a filter 174 is disposed in the opening.

The spaces 171 between the beam portions 170*a* are connected via the opening portion in which the filter 174 is formed, and thus the common liquid chamber is formed through all of the print head 150.

The filter 174 is made by nickel electroforming, for example, and is sandwiched between the two filtering and damping plates 172. The filter 174 is provided in order to remove foreign matter when ink flows through the common liquid chamber formed by laminating, in other words, the spaces 171 between the beam portions 170*a* shown in FIG. 12A. The mesh size of the filter 174 is preferably equal to or smaller than the nozzle diameter, and is set to approximately 10 μm. An electric wire hole (through hole) 172*a* and a sensor column hole (through hole) 172*b* are also formed in the filtering and damping plates 172.

Next, as shown in FIGS. 10A and 10B, another wiring plate (common liquid chamber plate) 175 is laminated onto the filtering and damping layer. A thermistor electrode and a heater plate 176 are laminated onto the wiring plate 175 in order to control temperature of the entire laminated plates. For example, the heater plate 176 is formed by patterning a resistance layer onto a stainless steel thin plate, and is formed with an electric wire hole (through hole) 176*a* and a sensor column hole (through hole) 176*b*, as shown in FIG. 11D.

Finally, as shown in FIGS. 10A and 10B, a power board is laminated onto the heater layer 176, and is constituted by a multi-layer flexible cable 168 which has bumps and packages a driver IC and the like.

In this manner, the print head 150 shown in FIGS. 9 and 10 is formed by laminating the plate members shown in FIGS. 11 and 12.

Next, the procedure for assembling the print head 150 by laminating together the various plate members shown in FIGS. 11 and 12 will be described.

Firstly, the flow channel extending from the pressure chamber 152 to the nozzle 151 is formed by laminating and joining a plurality of plate members. More specifically, the nozzle plate 165, sensor plate 166, pressure chamber plate 167, and diaphragm 156 are joined using an epoxy adhesive or the like. Therefore, in the pressure chamber 152 comprising the supply port (supply restrictor) 153 and the nozzle 151, the diaphragm 156 is formed on the ceiling face, and the sensor plate 166 is formed on the bottom face.

Figure 13:
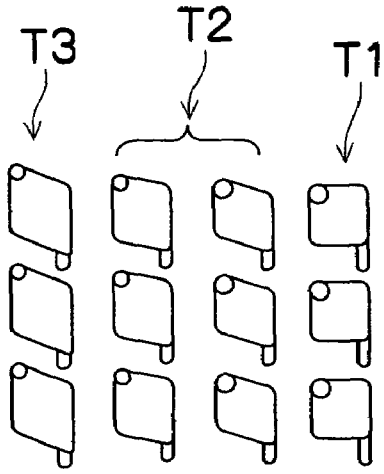
FIG. 13 is a plan view showing other forms of the pressure chamber.

Incidentally, the planar form of the pressure chamber 152 is not limited to the square shape described above. For example, instead of the square shape shown as T1 in FIG. 13, the planar form of the pressure chamber 152 may take the form of a parallelogram shown as T2 in FIG. 13, or may take a rhomboid form shown as T3 in FIG. 13.

Next, the piezo 158 is adhered to the laminated flow channel formed on top face. More specifically, the piezo 158 is adhered to the diaphragm 156 laminated onto the flow channel formed in the uppermost face, and then is subjected to insulation processing. At this time, electrode patterning is performed on the piezo 158 through metal sputtering or the like, in order to form the individual electrode 157.

Next, the piezo cover 169 is joined to the piezo 158 by epoxy adhesion or the like. As described above, the piezo cover 169 is subjected to half-etching in the part corresponding to the piezo 158 in order to prevent from making contact with the piezo 158.

Next, the nozzle 151 is formed in the nozzle plate 165 from the ejection side by means of abrasion processing using an excimer laser or the like. At this time, the nozzle 151 is preferably fashioned in a tapered form so that the ejection side contracts. The reason for forming the nozzle 151 in the nozzle plate 165 after laminating the nozzle plate 165 is to prevent blockages during adhesion and to improve the formation precision.

When the print head 150 has been formed from the nozzle 151 to the piezo cover 169, an inspection is performed using an inspection jig which determines whether or not the piezo 158 can be driven correctly.

Figure 14:
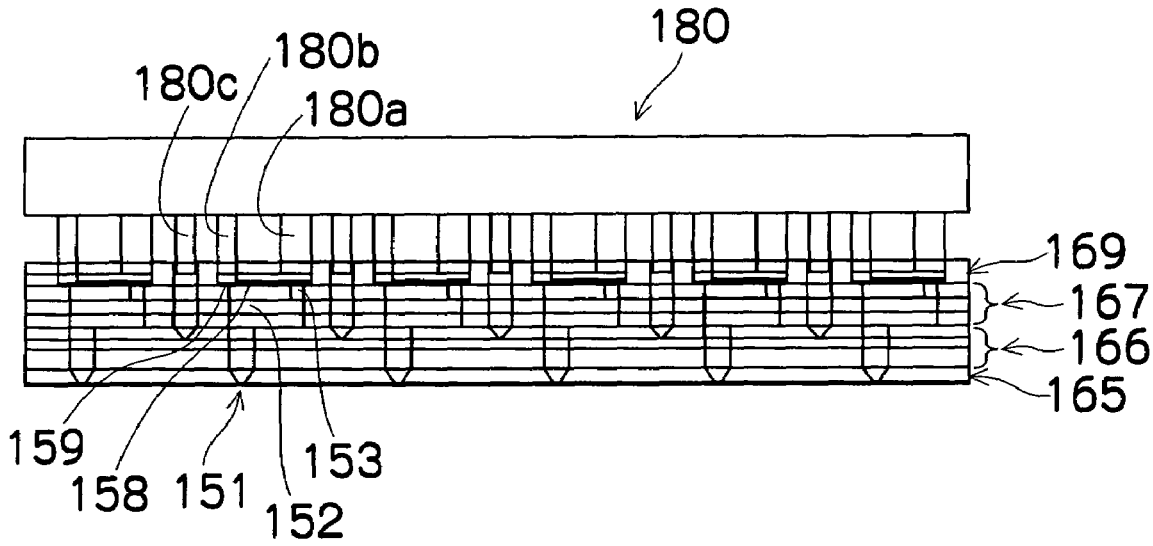
FIG. 14 is an illustrative view showing a state that an inspection using a jig is performed on a laminated flow channel.

Herein, the method of performing inspection by the inspection jig will be described with reference to FIG. 14. As shown in FIG. 14, an inspection jig 180 comprises an ink supply tubular duct 180*a*, and inspection probes 180*b* and 180*c*. First, the tubular duct 180*a* of the inspection jig 180 is placed on the supply port (supply restrictor) 153, the probe 180*b* is placed on the electrode pad 159 of the piezo 158, and the probe 180*c* is placed on the electrode portion of the sensor plate 166.

Then, when ink is filled into the pressure chamber 152 from the tubular duct 180*a* via the supply restrictor 153, a drive signal is transmitted from the probe 180*b* to drive the piezo 158. Accordingly, since the pressure generated in the pressure chamber 152 is measured by the probe 180*c* placed on the sensor plate 166, the driving condition is determined.

If the determination result is favorable, then the assembly process is continued. If the determination result is unfavorable, then an electric wiring and ink supply system connections as described below are performed in relation to the laminated flow channels from the nozzle plate 165 to the piezo cover 169.

More specifically, the electric wires (electric columns) 162 and sensor columns 164 are then formed to rise upward from the electrode pad 159 of the piezo 158 perpendicular to the diaphragm 156 (piezo 158), while the space 171 as a common liquid chamber is formed. The wiring plate (common liquid chamber plate) 170, the filtering and damping plates 172, the wiring plate (common liquid chamber plate) 175, and the heater plate 176 are laminated onto the piezo cover 169 using epoxy adhesive, diffusion bonding, or the like. In addition, insulation processing is implemented similarly to that of the pressure chamber plate 167, a conductive layer is formed on the inside of the holes, and then a filling material is filled therein.

At this time, the part which connects to the electrode pad 159 may be coated with a conductive adhesive. Therefore, a space as a common liquid chamber is formed. Then, the flexible cable 168 as a power board is connected on the space by means of a solder fusing using a heat press.

Then, conduction to the piezo 158 and sensor plate 166 is determined again using the inspection jig 180.

Figure 15:
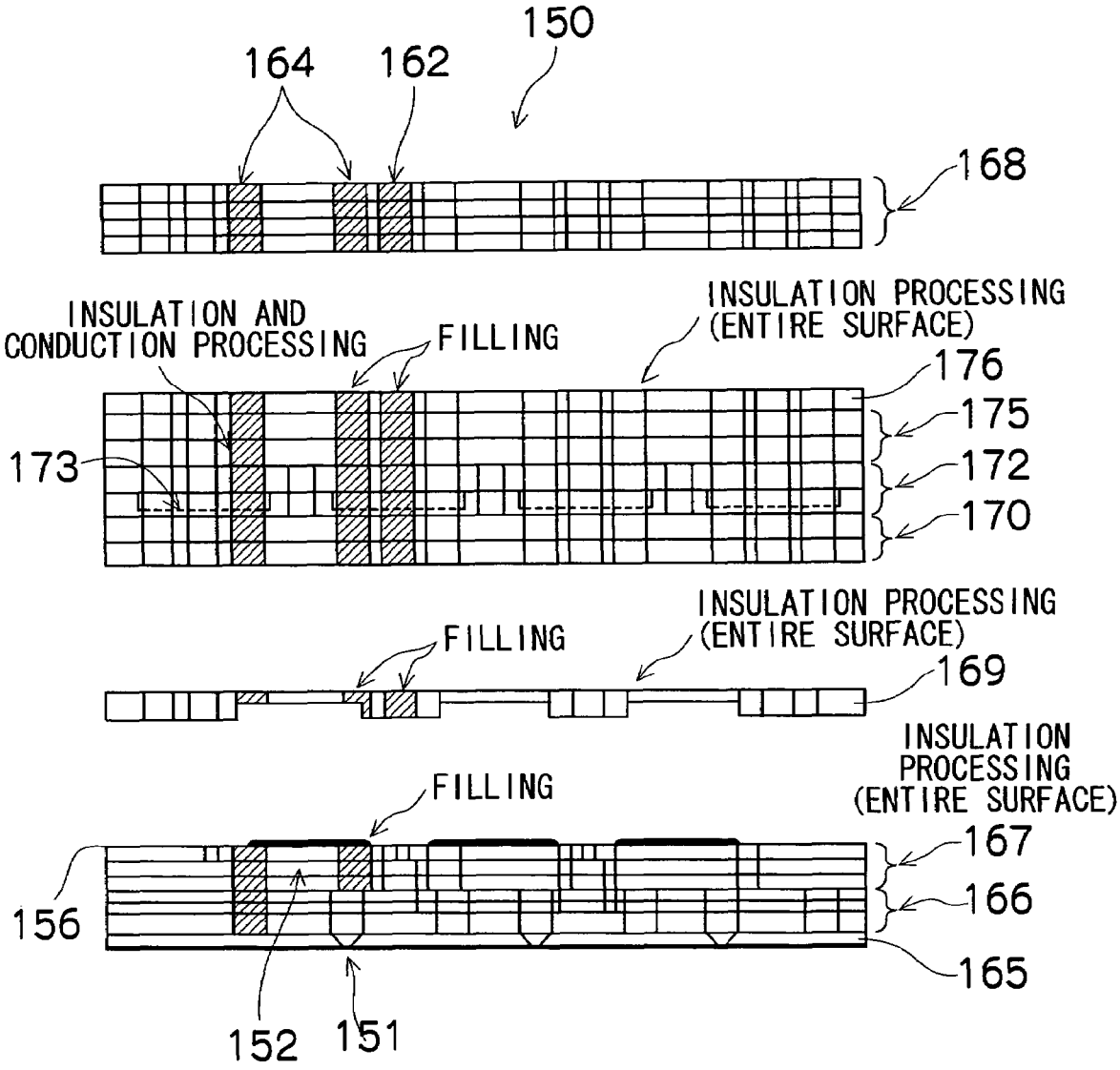
FIG. 15 is a side view showing a filling connection.
Figure 16A:
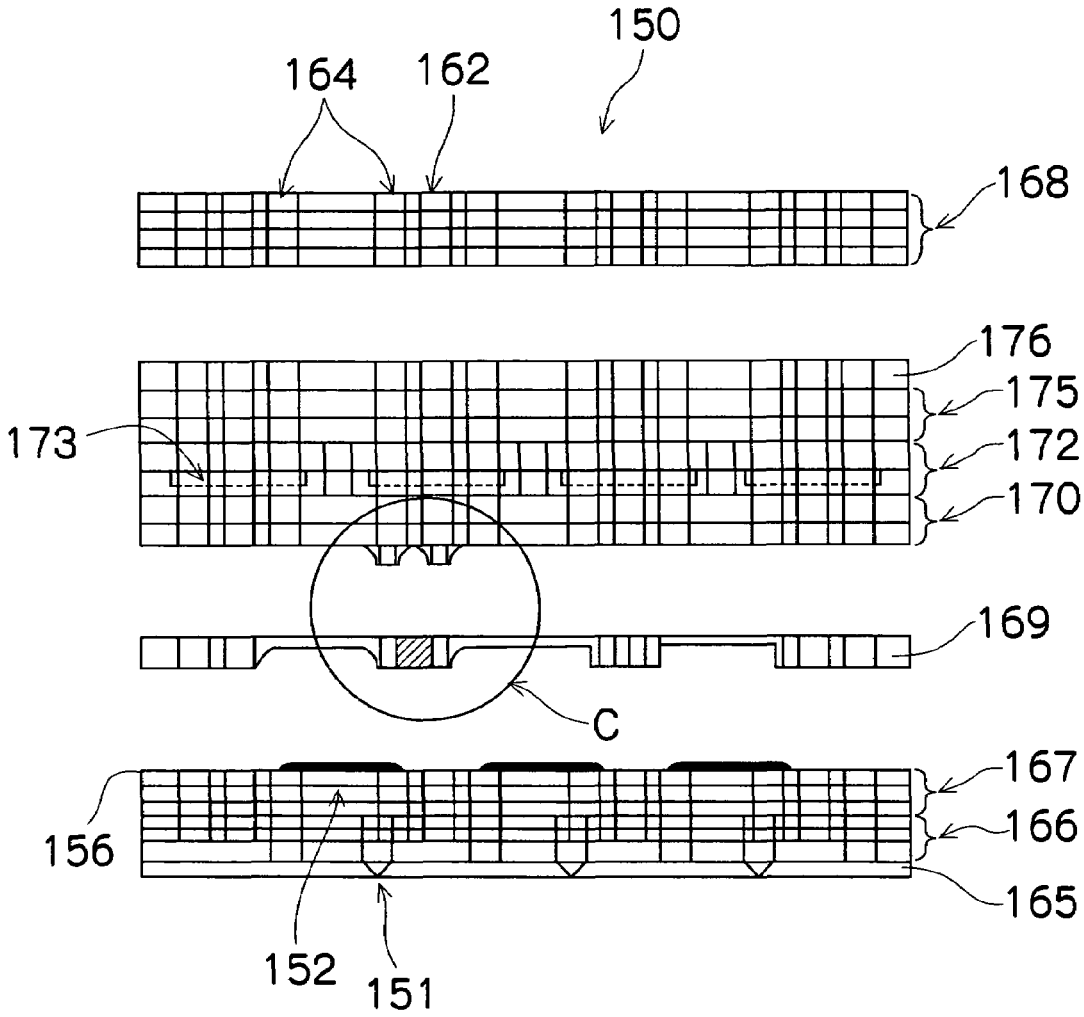
FIGS. 16A and 16B are side views showing a spherical connection.
Figure 16B:
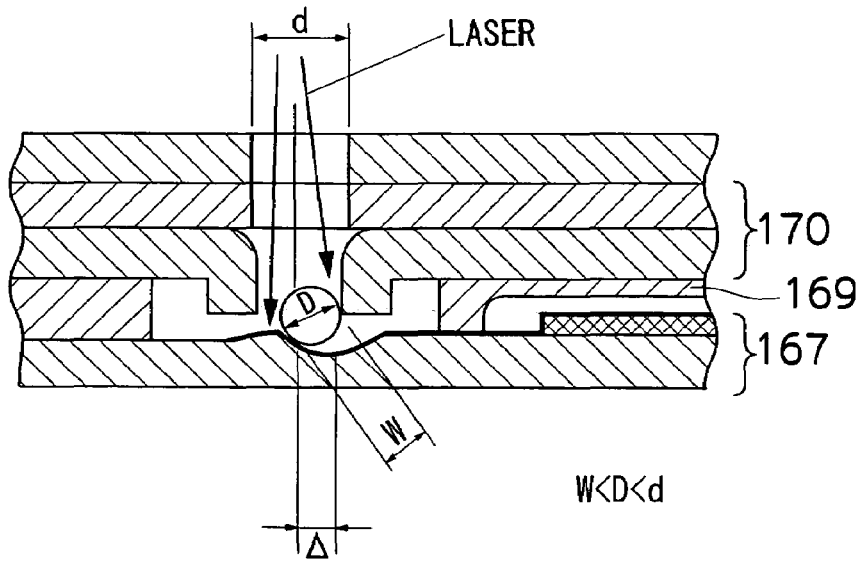

Heretofore, though a structure in which an electrode is drawn out from the piezo or sensing portion by filling a filling material into the laminated plates have been described as shown in FIG. 15, an electric connection member such as a sphere may also be used as a second method shown in FIGS. 16A and 16B. In other words, an electric connection member coated by such as solder plating is inserted into a hole, and is irradiated by such as a laser to melt the solder, thereby establishing a connection.

FIGS. 16A and 16B show a sphere connection method. FIG. 16B shows an enlarged view of a circular part indicated as a reference symbol C in FIG. 16A.

As shown in FIG. 16B, for example, if a recessed form portion which is offset from the center of the aforementioned hole by A is formed in a portion of the electrode part, then the connection member stability makes contact with the side face of the hole. In addition, the solder can be melted reliably during laser radiation, so that the electrode part does not shade the connection member.

Furthermore, if a protruding form portion is formed in a portion of the wiring plate 170 by pressing or the like, then the piezo cover 169 need not be subjected to insulation and conduction processing, and the connection member can be reduced in size.

If the result of inspection using the inspection jig 180 is favorable, a supply port which supplies the ink is adhered to the common liquid chamber, finally. Then, the assembled laminated substrate is incorporated into housing, and the flexible cable is fixed.

Therefore, assembly of the print head 150 is complete.

As described above, according to the present embodiment, since the electric wires of the piezo and sensing portion are formed in a laminated thin plate structure, then a high-density three-dimensional object with a high aspect ratio (thickness/hole diameter) can be formed easily. Furthermore, since the columnar electric wires (electric columns) and ejection flow channels are formed mainly by stainless steel etching, then a structure having a small linear expansion difference with the ejection unit can be manufactured at low cost. Moreover, since the piezo cover is formed in half-cut form through half-etching or the like, then a reliable piezo-protecting structure can be formed easily and at low cost.

In addition, the noise resistance property of the ejection determination signal is improved by the shielding effect of the stainless steel. Moreover, the thermal conductivity of stainless steel is better than that of resin or the like, thereby leading to a reduction in locality during temperature adjustment of the print head. If metallic bonding such as diffusion bonding or brazing is used, it is possible to achieve further increases in rigidity, quality, and reliability.

Next, a third embodiment of the present invention will be described.

Figure 17:
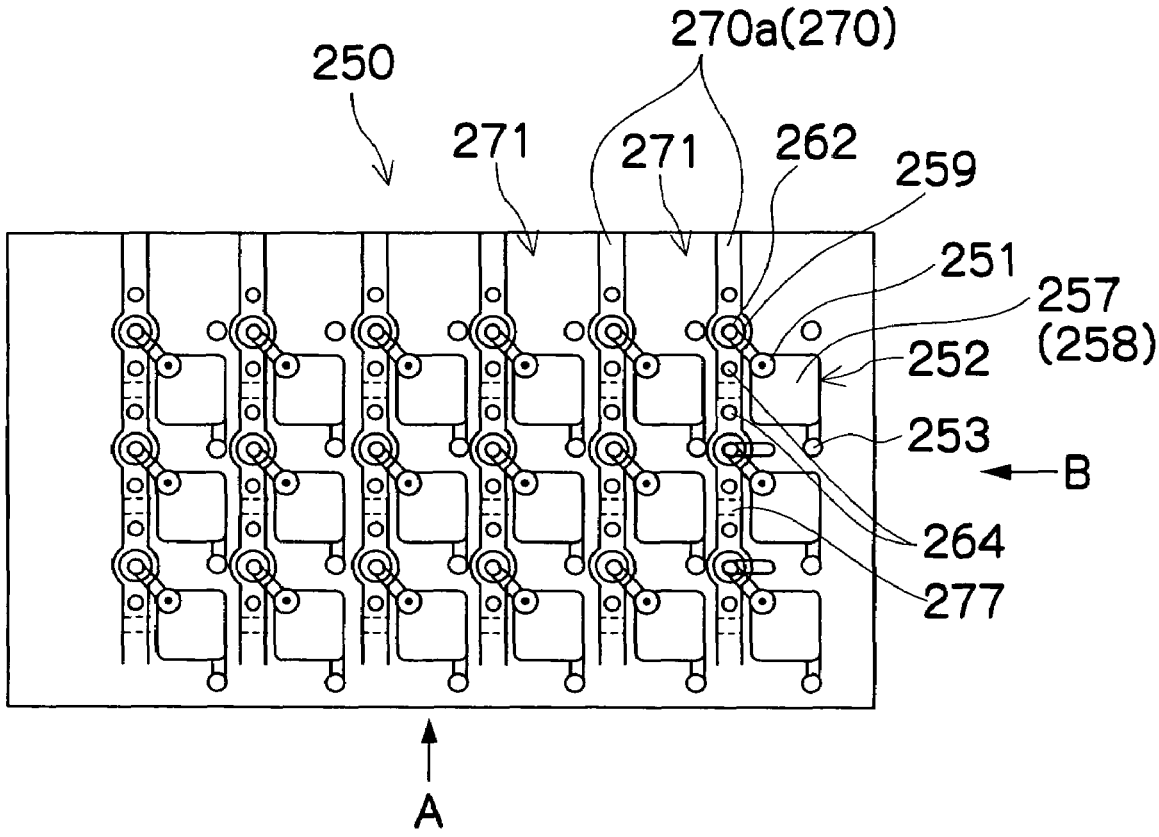
FIG. 17 is a perspective plan view of a print head according to a third embodiment of the present invention.
Figure 18A:
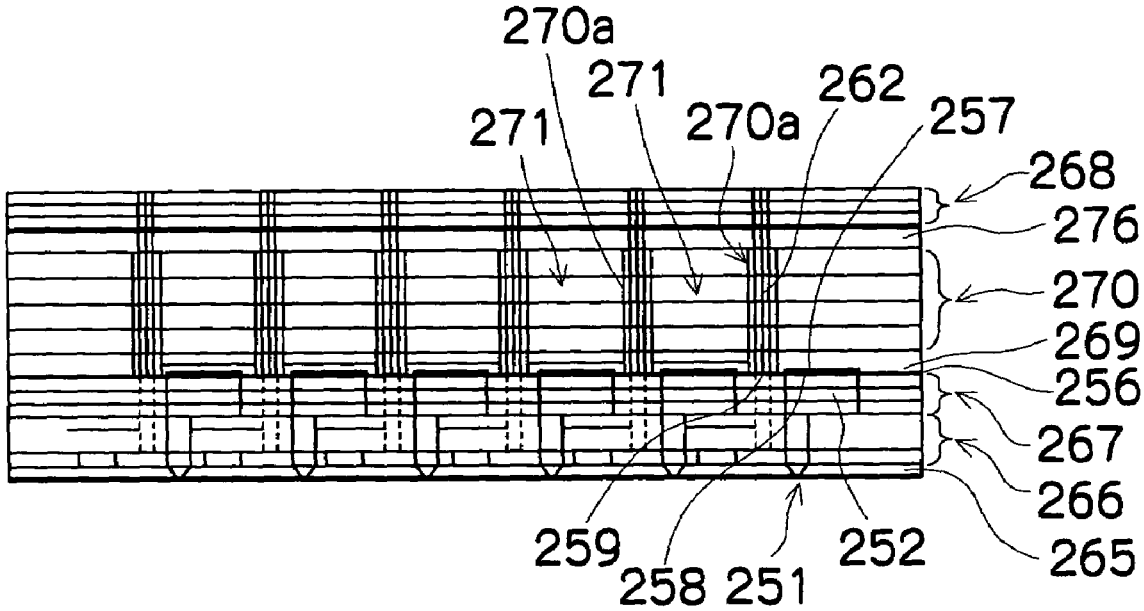
FIGS. 18A and 18B are perspective side views of the print head according to a third embodiment, FIG. 18A being a view when seen from a direction of an arrow A in FIG. 17, and FIG. 18B being a view when seen from a direction of an arrow B in FIG. 17.
Figure 18B:
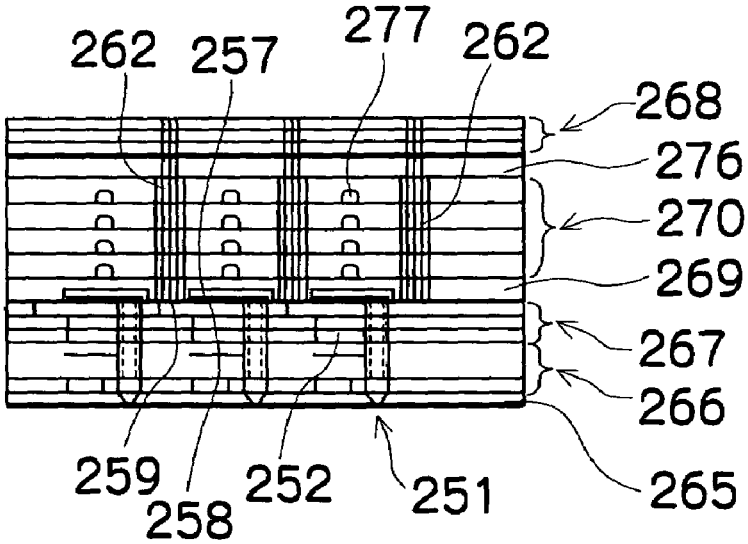

FIG. 17 shows a perspective plan view of a print head 250 according to the third embodiment. FIG. 18A shows a perspective side view of the print head 250 when seen from the direction of an arrow A in FIG. 17, and FIG. 18B shows a perspective side view of the print head when seen from the direction of an arrow B in FIG. 17.

In the print head 250 according to the present embodiment, as similar to the second embodiment described above, thin plates (from the wiring plate to the common liquid chamber plate) having beam portions 270*a* are laminated together to form columnar electric wires (electric columns) 262, and a portion of the laminated layers is formed in a connecting structure by means of half-etching, thereby connecting spaces 271 between the laminated beam portions 270*a* in order to form a common liquid chamber through which the ink can flow.

As shown in FIG. 17, a plurality of pressure chambers 252 which respectively comprise a supply restrictor 253 and a nozzle 251, are arranged in a staggered two-dimensional matrix form. An electrode pad 259 is formed so as to extend from an individual electrode 257, which drives a piezo 258 which deforms the pressure chamber 252 to the outside of the pressure chamber 252. An electric wire (electric column) 262 is formed by laminated wiring plates 270, which rises upward from the electrode pad 259 so as to be substantially perpendicular to the face formed with the piezo 258. A sensor column 264 is also formed by the laminated wiring plates 270, which extracts a determination signal from a sensor plate 266 (see FIGS. 18A and 18B) provided on the bottom face of the pressure chamber 252.

Incidentally, each of the beam portions 270*a* constituting the wiring plate 270 comprises a half-etched connecting portion 277 shown by the broken lines, and then this connecting portion 277 serves to connect spaces 271 between the beam portions 270*a* which function conventionally as ink supply tributaries.

Since the connecting portion 277 connects the spaces 271 between the beam portions 270*a*, the ink can flow between the spaces 271, and hence the spaces 271 connected through all of the print head 250 is formed as a common liquid chamber.

As shown in FIGS. 18A and 18B, a nozzle plate 265, a sensor plate 266, a pressure chamber plate 267, a diaphragm 256 in which the piezo 258 and individual electrode 257 are formed, a piezo cover 269, the wiring plate (common liquid chamber plate) 270, a heater layer 276, and a multi-layer flexible cable 268 as a power board, are laminated in sequence from the bottom in the print head 250 according to the present embodiment, as similar to the print head 150 according to the second embodiment described above.

In particular, as shown in FIG. 18B, a half-etched connecting portion 277 is formed in the respective wiring plates 270 in order to connect the spaces 271 (see FIG. 18A) between the beam portions 270*a* of the respective wiring plates 270.

Figure 19:
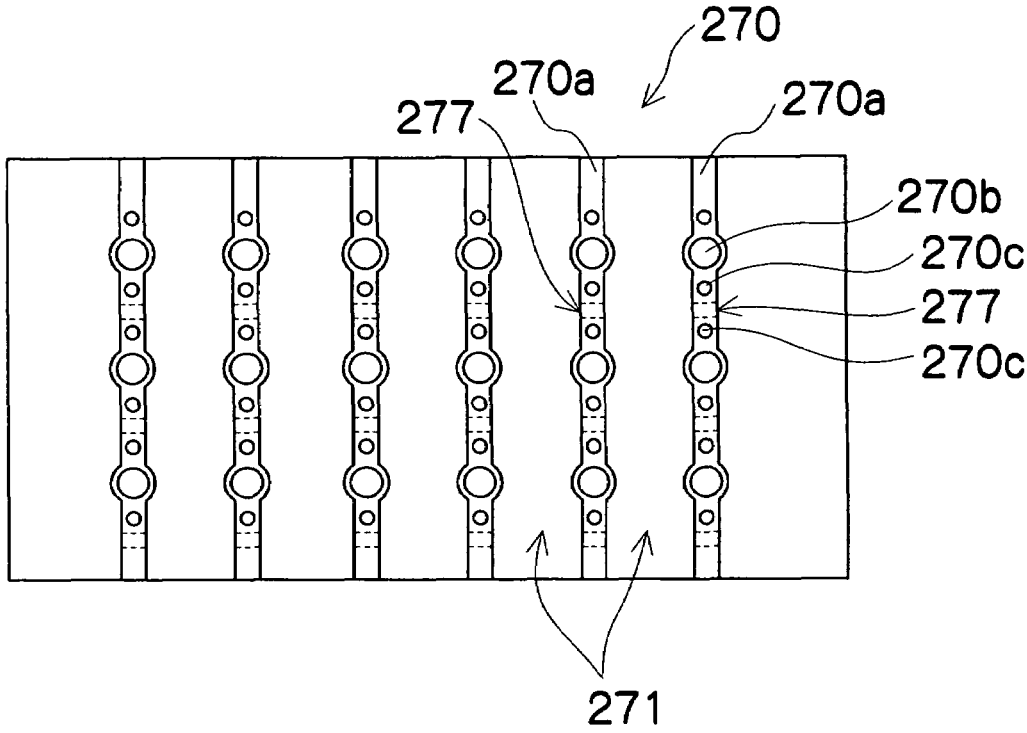
FIG. 19 is a plan view showing a wiring plate according to the third embodiment.

FIG. 19 is a plan view of the wiring plate (common liquid chamber) 270 according to the present embodiment. As shown in FIG. 19, the wiring plate 270 in the present embodiment is similar to the wiring plate 60 shown in FIG. 7A that a single plate is formed by connecting a plurality of elongated strip-formed beam portions 270*a* at each end thereof, while an electric wire hole 270*b* and a sensor column hole 270*c* are formed in each beam portion 270*a*.

In addition, according to the present embodiment, the connecting portion 277 is formed by half-etching, which connects the spaces 271 between the beam portions 270*a* so as to be able to flow the ink. As shown in FIGS. 18A and 18B, in the present embodiment, four wiring plates 270 are laminated together to form the columnar electric wire (electric column) 262, the sensor column 264, and the spaces 271 as a common liquid chamber.

Next, a fourth embodiment of the present invention will be described.

Figure 20:
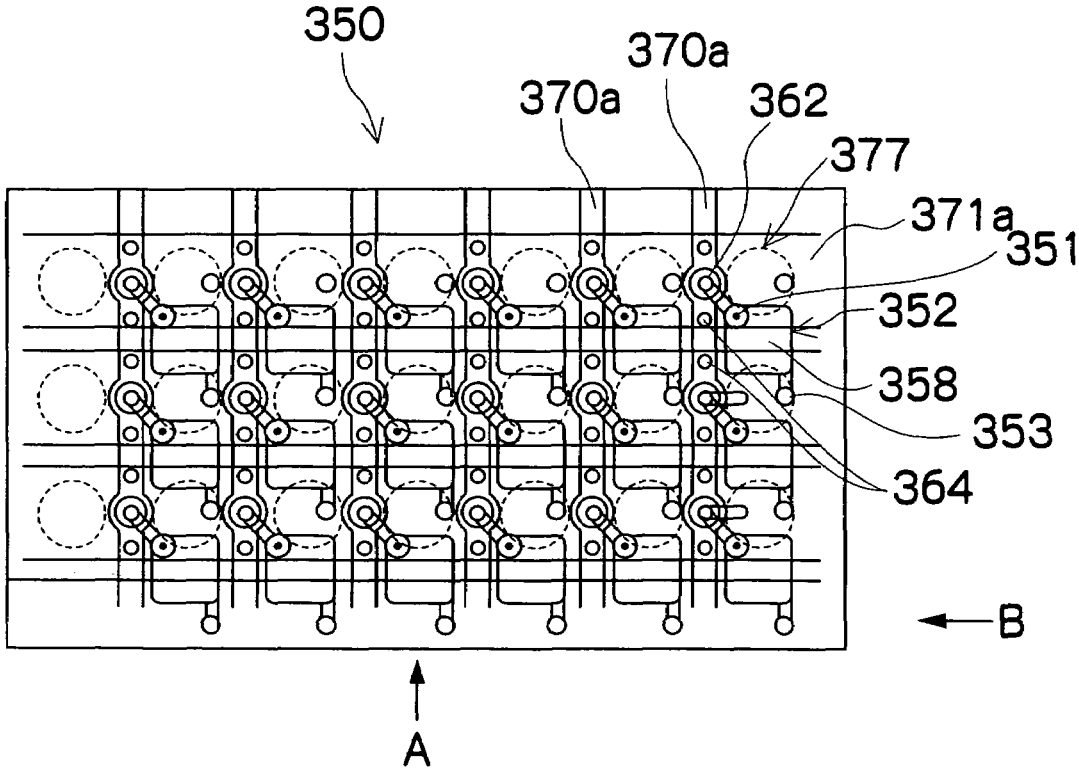
FIG. 20 is a perspective plan view of a print head according to a fourth embodiment of the present invention.
Figure 21A:
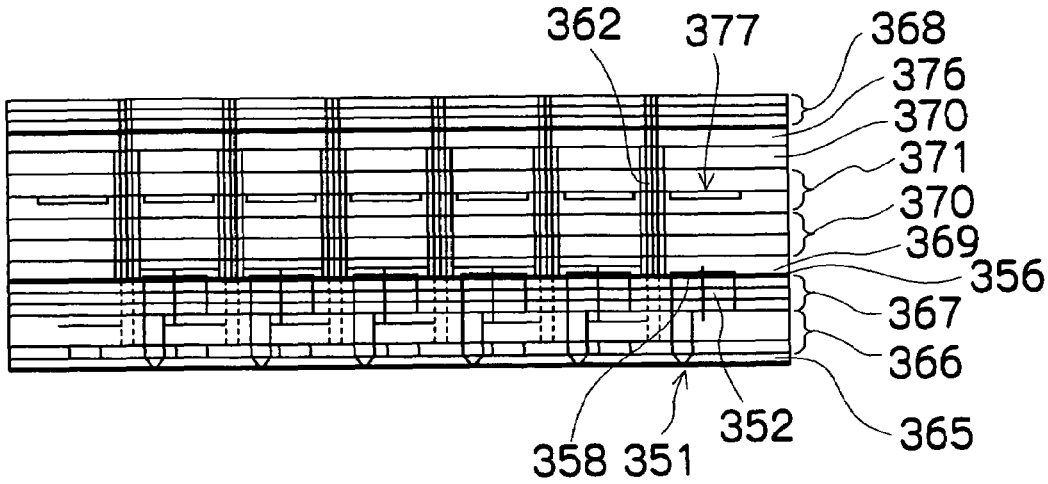
FIGS. 21A and 21B are perspective side views of the print head according to the fourth embodiment, FIG. 21A being a view when seen from a direction of an arrow A in FIG. 20, and FIG. 21B being a view when seen from a direction of an arrow B in FIG. 20.
Figure 21B:
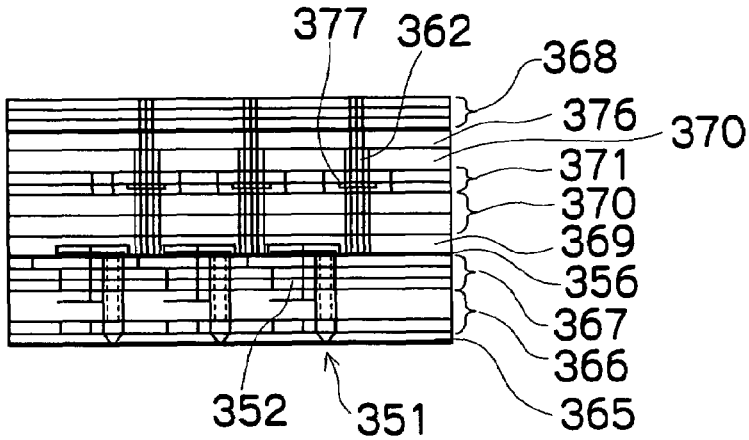

FIG. 20 shows a perspective plan view of a print head 350 according to the fourth embodiment. FIG. 21A shows a perspective side view of the print head 350 when seen from the direction of an arrow A in FIG. 20, and FIG. 21B shows a perspective side view of the print head 350 when seen from the direction of an arrow B in FIG. 20.

In the print head 350 according to the present embodiment, two types of thin plates (from the wiring plate to the common liquid chamber plate) 370 and 371 having beam portions 370*a* are laminated to form the columnar electric wire (electric column) 362. In addition, a portion of one of the two types of thin wiring plates 370 and 371 having beam portions 370*a* is subjected to half-etching so that a void 377 is provided in a position above the supply restrictor 353 when laminating. This void 377 has a damper function which eases the pressure generated during ejection.

As shown in FIG. 20, a plurality of pressure chambers 352 which respectively comprise a supply restrictor 353 and a nozzle 351, are arranged in a staggered two-dimensional matrix form. An electric wire (electric column) 362 which supplies a drive signal to a piezo 358 for deforming the pressure chamber 352 is formed by laminated wiring plates 370 and 371. A sensor column 364 is also formed by the laminated wiring plates 370 and 371, which extracts a determination signal from a sensor plate 366 (see FIGS. 21A and 21B) provided on the bottom face of the pressure chamber 352.

Figure 22:
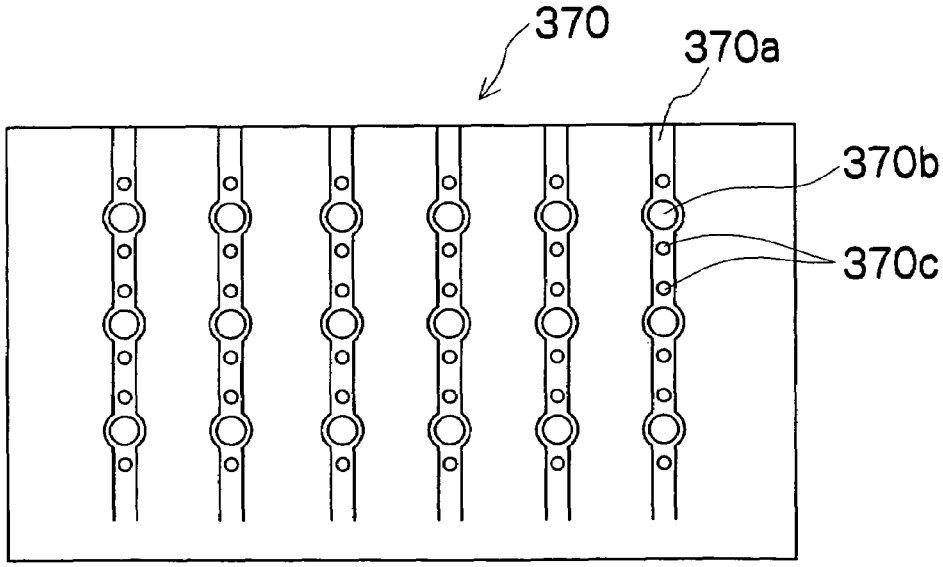
FIG. 22 is a plan view showing an example of a wiring plate according to the fourth embodiment.
Figure 23:
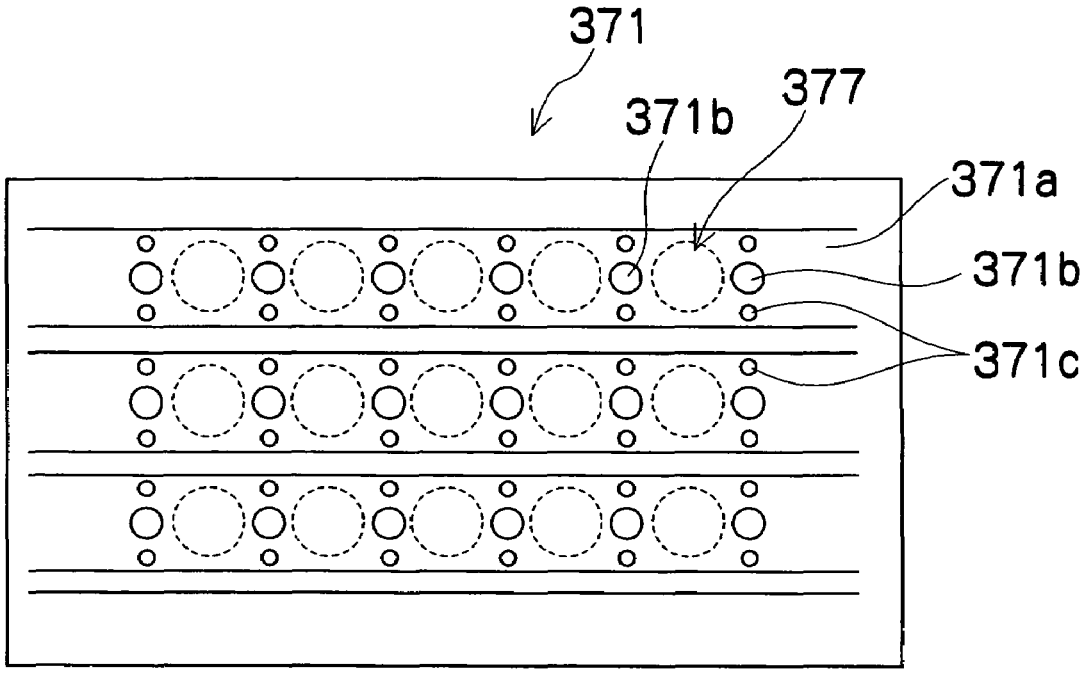
FIG. 23 is a plan view showing another example of the wiring plate according to the fourth embodiment, indicating the wiring plate formed with a damper portion produced by half-etching.

FIGS. 22 and 23 show respective plan views of the two types of wiring plates 370 and 371 according to the present embodiment.

The wiring plate 370 shown in FIG. 22 is similar to the wiring plate 60 shown in FIG. 7A that a single plate is formed by connecting a plurality of elongated strip-formed beam portions 370*a* at each end thereof, while an electric wire hole 370*b* and a sensor column hole 370*c* are formed in each beam portion 370*a*.

The wiring plate 371 shown in FIG. 23 has beam portions 371*a* formed in an orthogonal direction to those of the wiring plate 370 shown in FIG. 22, a single plate being formed by connecting the beam portions 371*a* at each end thereof. An electric wire hole 371*b* and a sensor column hole 371*c* are formed in positions corresponding to those wire holes 370*b* and 370*c* in the wiring plate 370 shown in FIG. 22 when the wiring plates 370 and 371 are laminated. Furthermore, a void 377 is formed in a circular form on the wiring plate 371 by half-etching between the respective electric wire holes 371*b* of beam portions 371*a*. When the print head 350 is formed by laminating the various plate members, the void 377 is formed in a position corresponding to the supply restrictor 353. The void 377 portion exhibits a damper function which eases the pressure generated during ejection via the supply restrictor 353.

As shown in FIGS. 21A and 21B, a nozzle plate 365, the sensor plate 366, a pressure chamber plate 367, the diaphragm 356 which the piezo 358 and an individual electrode 357 are formed, a piezo cover 369, the wiring plates (common liquid chamber plates) 370 and 371, a heater layer 376, and a multi-layer flexible cable 368 as a power board, are laminated in sequence from the bottom in the print head 350 according to the present embodiment, as similar to the print head 250 according to the third embodiment described above.

In particular, as shown in FIGS. 21A and 21B, the wiring plates 370 and 371 are laminated so that the two wiring plates 371 are sandwiched by two wiring plates 370 and one wiring plate 370.

Only one of the two laminated wiring plates 371 comprises the half-etched void 377 as shown in FIG. 23, and the other remains in a flat plate form. By laminating those wiring plates 370 and 371 to each other, the void 377 is formed as shown in FIG. 21A or 21B.

Accordingly, since a portion of the laminated layers is half-cut (half-etched) to provide a damper function in this embodiment, it is possible to reduce the crosstalk that accompanies ink backflow during ink ejection.

A fifth embodiment of the present invention will now be described.

Figure 24:
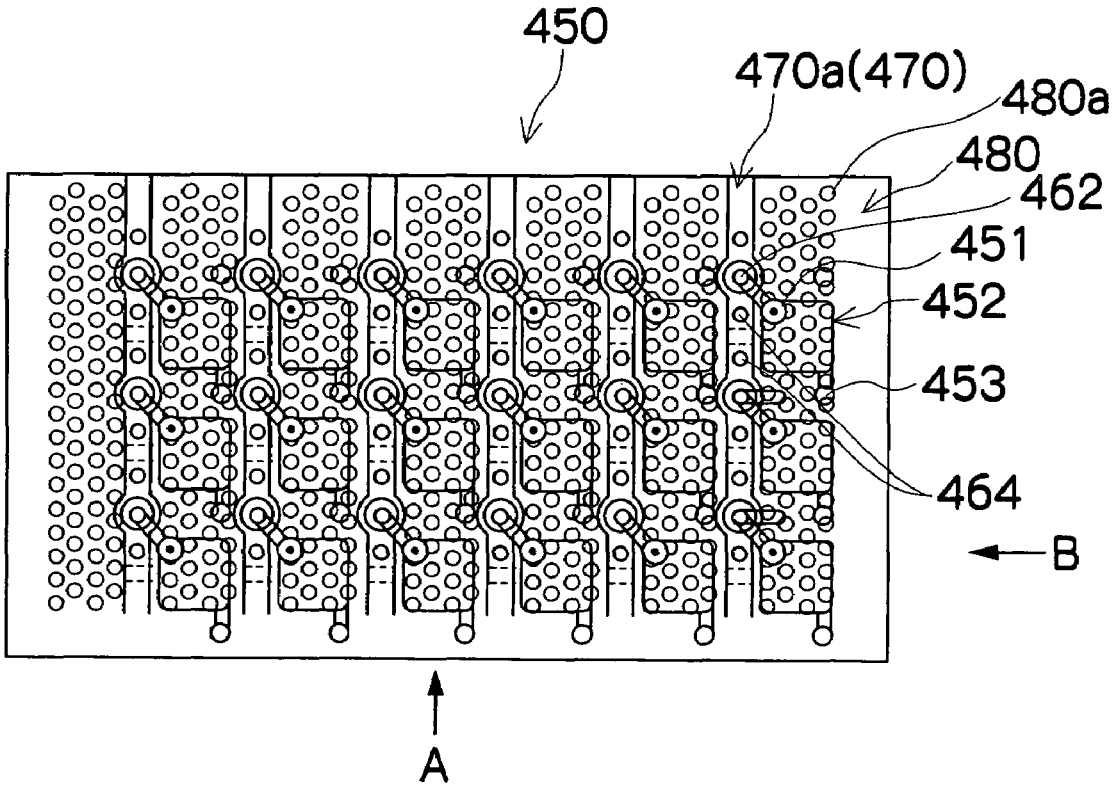
FIG. 24 is a perspective plan view of a print head according to a fifth embodiment of the present invention.
Figure 25A:
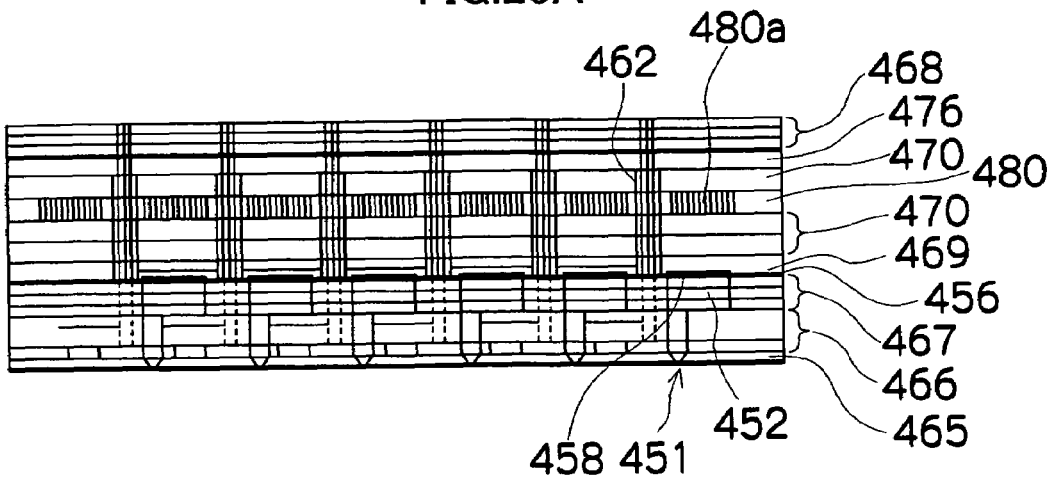
FIGS. 25A and 25B are perspective side views of the print head according to the fifth embodiment, FIG. 25A being a view seen from the direction of an arrow A in FIG. 24, and FIG. 25B being a view seen from the direction of an arrow B in FIG. 24.
Figure 25B:
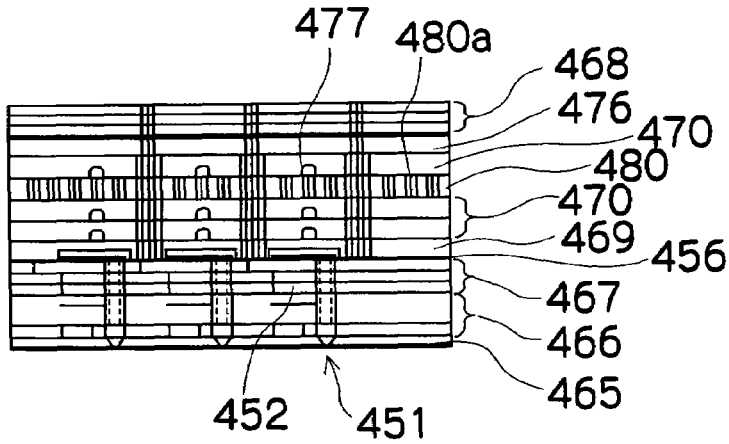
Figure 26:
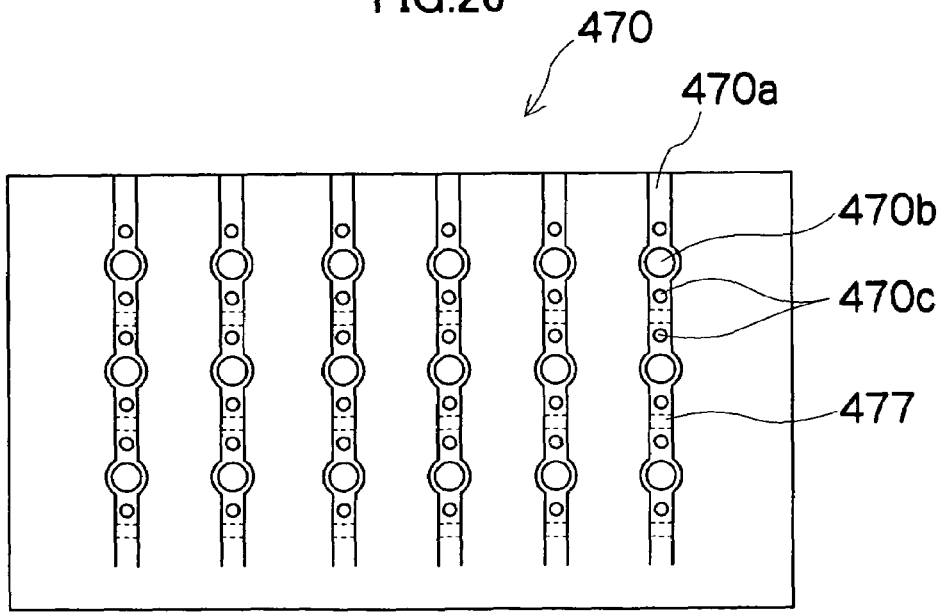
FIG. 26 is a plan view showing an example of a wiring plate according to the fifth embodiment.

FIG. 24 shows a perspective plan view of a print head 450 according to the fifth embodiment. FIG. 25A shows a perspective side view of the print head 450 when seen from the direction of an arrow A in FIG. 24, and FIG. 25B shows a perspective side view of the print head 450 when seen from the direction of an arrow B in FIG. 24. FIG. 26 shows a plan view of a laminated wiring plate 470 according to the present embodiment, and FIG. 27 shows a plan view of a laminated mesh plate 480 according to the present embodiment.

Figure 27:
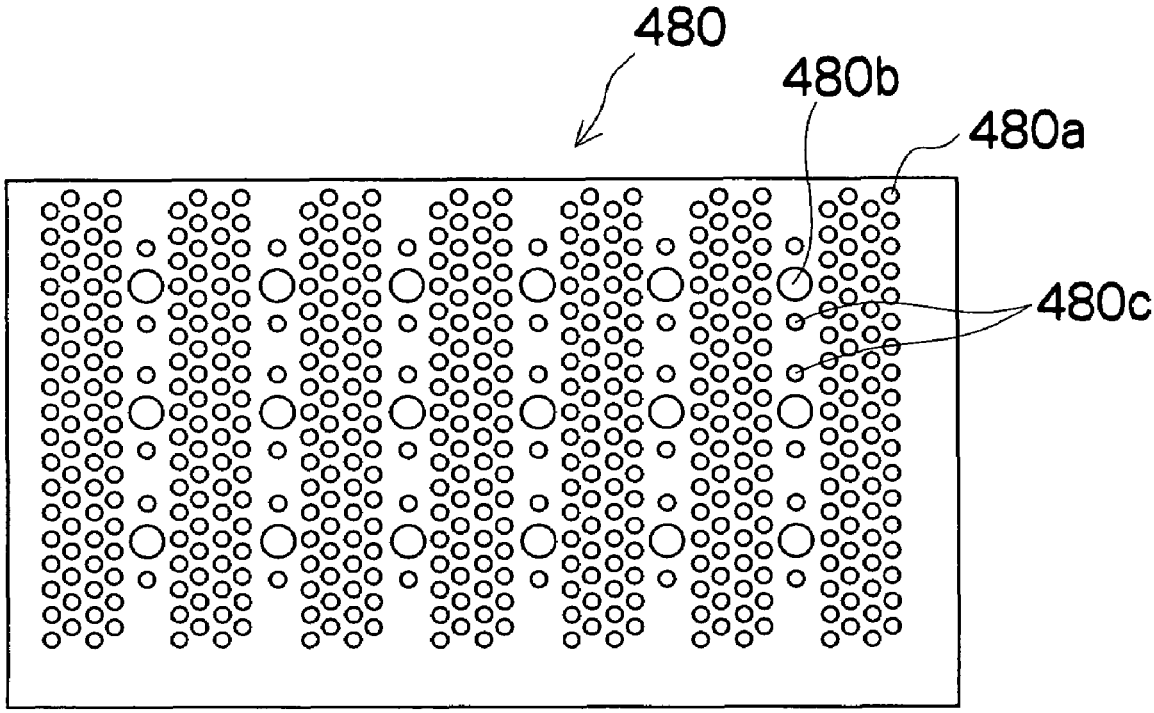
FIG. 27 is a plan view showing another example of the wiring plate according to the fifth embodiment, indicating the wiring plate formed with mesh.

In the present embodiment, a filter function is provided by inserting a mesh plate shown in FIG. 27 between a plurality of wiring plates shown in FIG. 26 which are laminated as described above in the third embodiment.

As shown in FIG. 24, a plurality of pressure chambers 452 which respectively comprise a supply restrictor 453 and a nozzle 451, are arranged in a staggered two-dimensional matrix form. An electric wire (electric column) 462 which supplies a drive signal to a piezo 458 for deforming the pressure chamber 452 is formed by laminated wiring plates 470. A sensor column 464 is also formed by the laminated wiring plates 470, which extracts a determination signal from a sensor plate 466 (see FIGS. 25A and 25B) provided on the bottom face of the pressure chamber 452.

As shown in FIG. 26, the laminated wiring plate 470 in the present embodiment is similar to that of the third embodiment shown in FIG. 19. In other words, a single plate is formed by a plurality of beam portions 470*a* connected at each end thereof, and then an electric wire hole 470*b*, a sensor column hole 470*c*, and a half-etched connecting portion 477 are formed in the respective beam portions 470*a*.

In the present embodiment, a mesh plate 480 shown in FIG. 27 is inserted between the laminated wiring plates 470. As shown in FIG. 27, the mesh plate 480 is formed with a large number of mesh-form holes 480*a*, as well as the electric wire holes 480*b* and the sensor column holes 480*c* . Therefore, the mesh plate 480 functions as a filter.

As shown in FIGS. 25A and 25B, a nozzle plate 465, a sensor plate 466, a pressure chamber plate 467, a diaphragm 456 in which the piezo 458 is formed, a piezo cover 469, the wiring plate (common liquid chamber plate) 470, the mesh plate 480, a heater layer 476, and a multi-layer flexible cable 468 as a power board, are laminated in sequence from the bottom in the print head 450 according to the present embodiment, as similar to the print head 350 according to the fourth embodiment described above.

In particular, as shown in FIGS. 25A and 25B, when laminating three wiring plates 470, then the mesh plate 480 is sandwiched between the laminated wiring plates 470. Therefore, since the mesh plate 480 having a large number of mesh-form holes 480*a*, is inserted between the laminated wiring plates 470, then the mesh-form holes 480*a* can exhibit a filtering function.

In this way, since a portion of the laminated layers is formed in mesh form in order to provide a filtering function, then efficient filtering with little loss is possible even if using a highly viscous liquid.

In each of the first to fifth embodiments described above, a heater layer is provided as a part of the laminated layers so that temperature of the print head 50, 150, 250, 350, and 450 can be adjusted. However, simply by providing a heater layer, it may be impossible to adjust the temperature of the print head 50, 150, 250, 350, and 450 to an appropriate temperature of approximately 40° C., when the piezo generates a large amount of heat during continuous printing or the like. Accordingly, it is necessary to form the ink supply system as a circulation supplies system, so that the circulated ink is used to cool the print head 50, 150, 250, 350, and 450.

Hereinafter, the ink supply system will be described.

The print heads 50, 150, 250, 350, and 450 described above are all similarly, and therefore the print head 50 according to the first embodiment will be used as a representative thereof in the following description.

Figure 28:
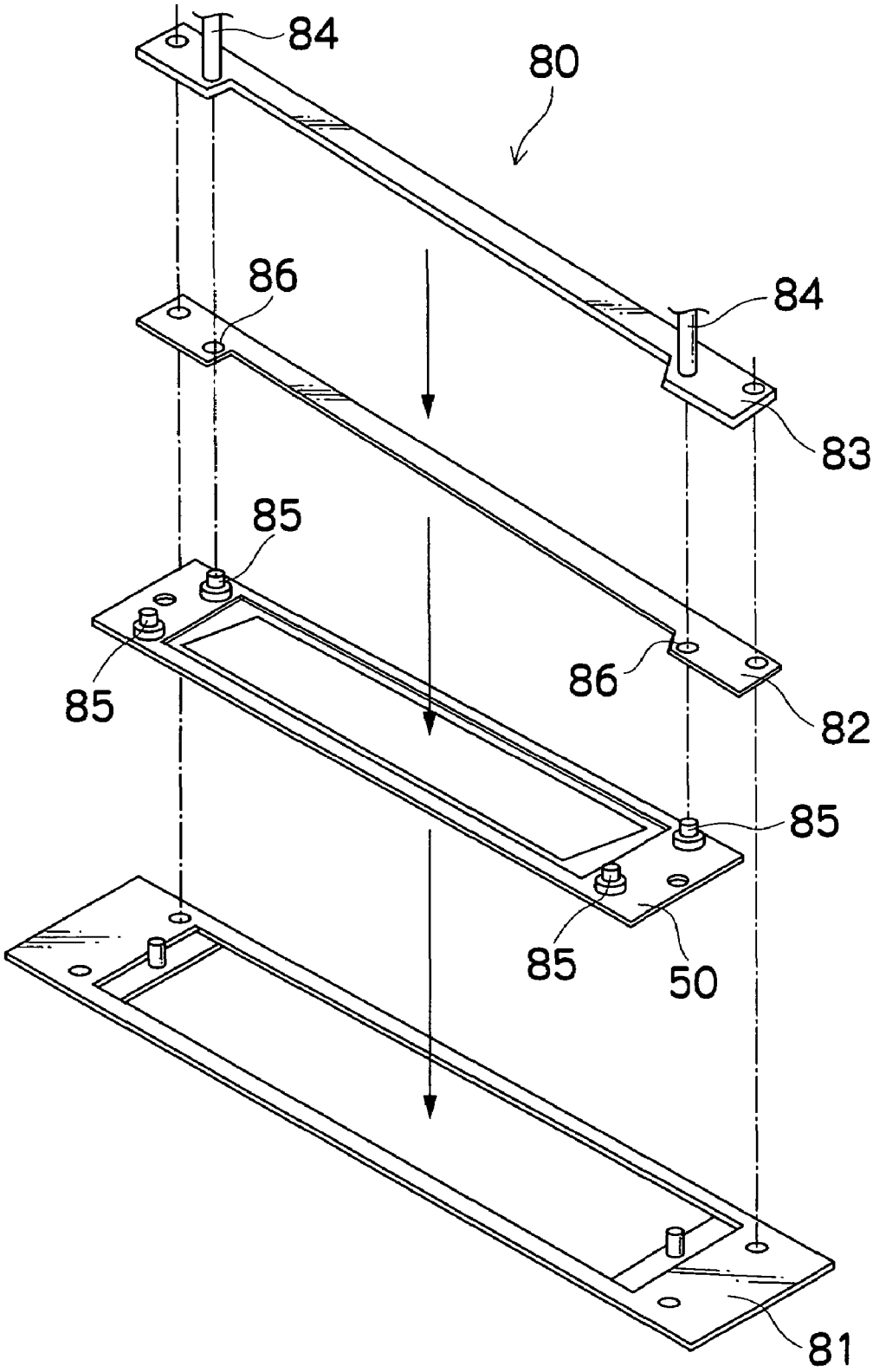
FIG. 28 is an exploded perspective view of a print head incorporated into an inkjet recording apparatus.

FIG. 28 shows an exploded perspective view relating to a method for attaching the print head 50 to the inkjet recording apparatus 10 according to the present invention.

When attaching the print head 50 to the inkjet recording apparatus 10, the attachment operation is performed in units of a head block 80 as shown in FIG. 28.

The print head 50 is fitted into a holder 81, sandwiched by an attachment 82, and fixed by a connecting plate 83. A supply pipe 84 which supplies the ink from an ink supply tank (not shown) to the print head 50 is provided in the connecting plate 83. A main supply port 85 of the print head 50 and the supply pipe 84 are connected by fixing the print head 50 to the connecting plate 83.

In this time, the supply pipe 84 and main supply port 85 are connected via rubber packing 86 for preventing ink leakage. Although not shown in the drawing, the attachment 82 and connecting plate 83 are also attached at the front side of FIG. 28.

Figure 29:
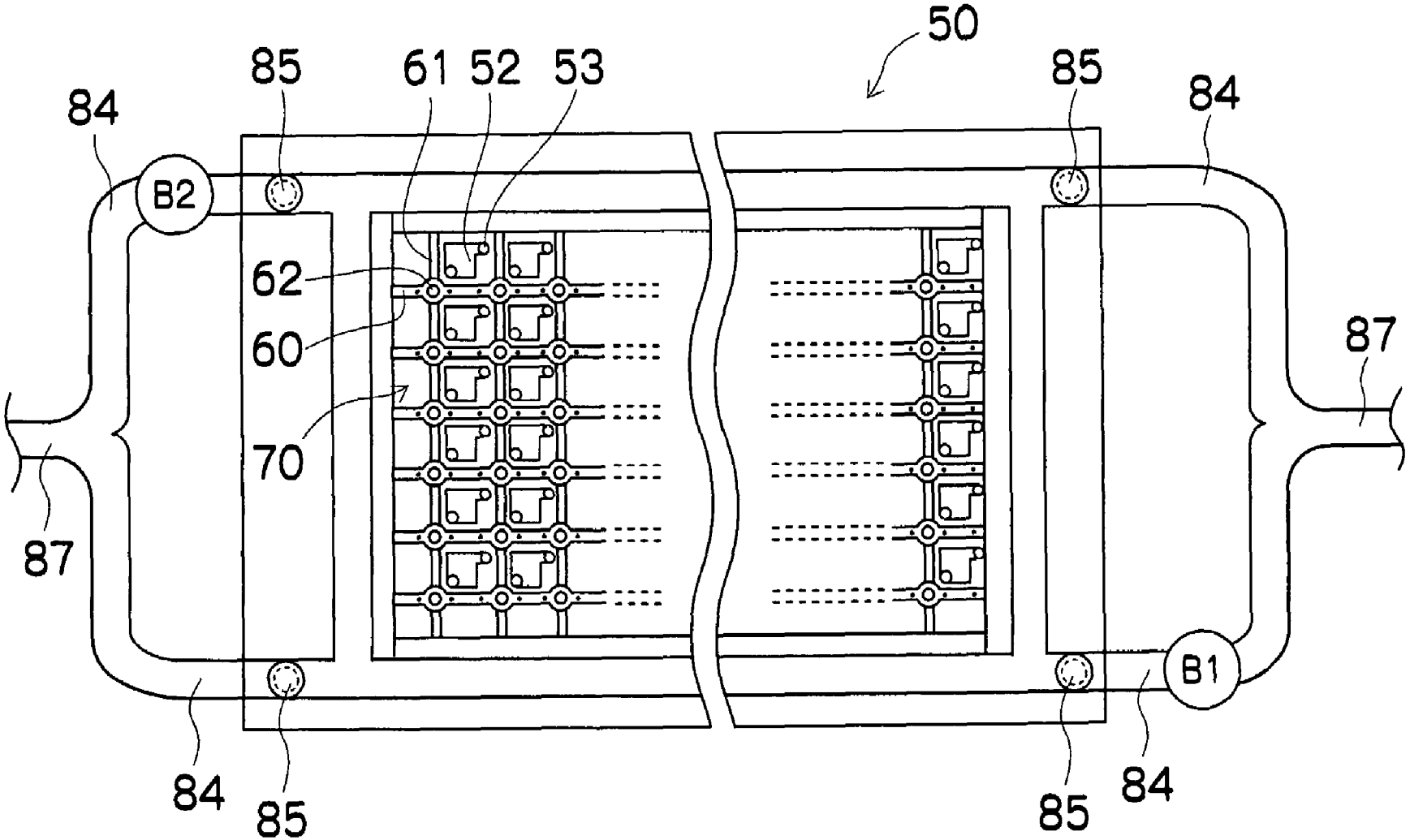
FIG. 29 is a perspective plan view showing an ink supply system of the print head.

FIG. 29 is a perspective plan view showing the ink supply system of the print head 50. As shown in FIG. 29, the print head 50 comprises an ink supply system constituted by a main flow channel 87 which supplies the ink from an ink supply tank (not shown in FIG. 29); two supply pipes 84 which branch from the main flow channel 87; main supply ports 85 which communicate with the supply pipes 84; Valves B1 and B2; and the like.

The print head 50 according to the first embodiment described above is used as an example of the print head 50 shown in FIG. 29. More specifically, the wiring plates 60 and 61 formed with substantially orthogonal beam portions are laminated alternately in a matrix form, the pressure chambers 52 are formed within the matrix grid, and the spaces 70 above the pressure chambers 52 are connected by the gaps between the beam portions laminated into the matrix form, thereby forming a single common liquid chamber connected through all of the print head 50. The columnar electric wires (electric columns) 62 are formed in the parts of the common liquid chamber that the laminated beam portions overlap to each other.

Likewise in the print heads according to the other embodiments described above, wiring plates formed with a plurality of beam portions are laminated together, and columnar electric wires (electric columns) are formed within the laminated layers in addition, an opening portion having a filter, a connection portion produced by half-etching, or a similar component is provided within the wiring plates to connect the spaces which are partitioned when the beam portions are laminated in a wall form so that the ink can flow through, and thus a single common liquid chamber is formed through all of the print heads.

As shown in FIG. 29, two supply pipes 84 branch from the main flow channel 87 at each of the left and right ends of the print head 50 in the lengthwise direction of the print head 50, and extend to the print head 50. The supply pipes 84 respectively connect to the main supply ports 85 which are formed in the four corners of the print head 50. The ink supplied to the print head 50 through the main supply ports 85 fills the interior of the common liquid chamber covering all of the print head 50, and is supplied to the pressure chambers 52 through the supply restrictor 53 provided for each pressure chamber 52.

The valves B1 and B2 as valve devices are disposed in the supply pipes 84 at diagonally opposing positions with respect to the print head 50. In the example shown in FIG. 29, the valve B1 is attached to the supply pipe 84 on the lower right side in the drawing, and then the valve B2 is attached to the supply pipe 84 on the upper left side in the drawing.

According to the ink supply system constituted in this manner, since no terminal end portions (in other words, no dead ends of the flow channel) exist in the supply system, then the ink retention does not occur. Therefore, the ink can flow smoothly without stopping.

Figure 30:
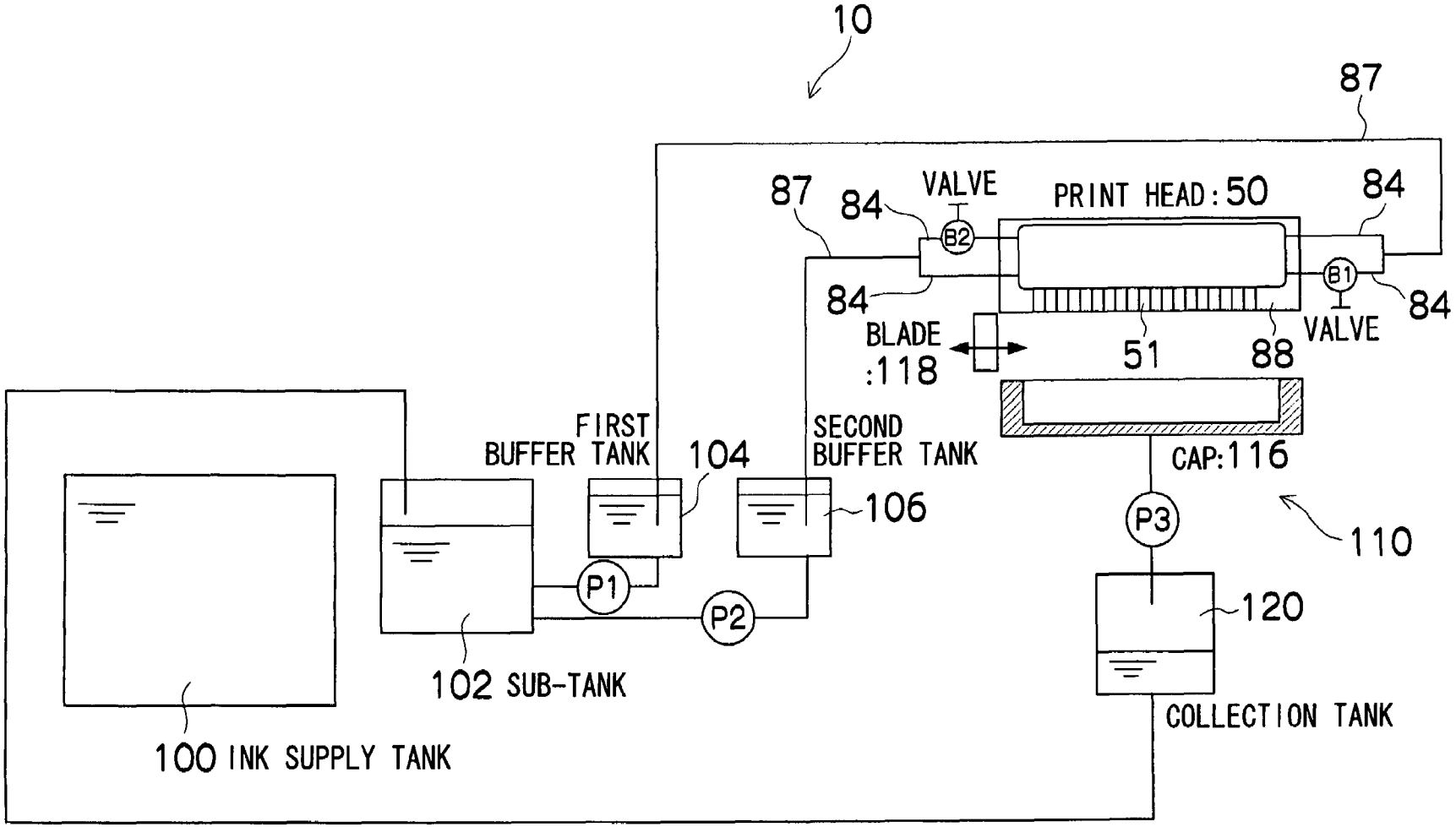
FIG. 30 is a schematic diagram showing composition of the ink supply system in an inkjet recording apparatus incorporated with the print head.

FIG. 30 is a schematic diagram showing a constitution of the ink supply system in the inkjet recording apparatus 10 incorporated with the print head 50.

As shown in FIG. 30, between an ink supply tank 100 and the print head 50, the inkjet recording apparatus 10 comprises a sub-tank 102, pumps P1 and P2, buffer tanks 104 and 106, a maintenance unit 110 for the print head 50, and the like.

The ink supply tank 100 is a base tank that supplies ink to the print head 50, and is disposed in the ink storing and loading unit 14 described with reference to FIG. 1, for example. The aspects of the ink supply tank 100 include a refillable type and a cartridge type: when the remaining amount of ink is low, the ink supply tank 100 of the refillable type is filled with ink through a filling port (not shown), and the ink supply tank 100 of the cartridge type is replaced. When the ink type is to be changed in accordance with the intended application, the cartridge type is preferable. In this case, it is preferable to represent ink type information with a bar code, IC chip, or the like, and to perform ejection control in accordance with the ink type.

The sub-tank 102 gathers the ink supplied from the ink supply tank 100, and removes as many air bubbles from the ink as possible. Instead of the sub-tank 102, or in addition to the sub-tank 102, a filter may be provided to remove foreign matter and air bubbles. Incidentally, a sensor for determining the presence of ink is preferably provided in the sub-tank 102.

The buffer tanks 104 and 106 are provided between the sub-tank 102 and print head 50 in the vicinity of the print head 50, or integrally with the print head 50. The buffer tanks 104 and 106 absorb the pulse (internal pressure variation) which is generated in the ink pressure in the flow channel when driving the pumps P1 and P2, thereby achieving a damper effect to maintain the pressure in the print head 50 at an appropriate constant value.

A maintenance unit 110 constituted by a cap 116 and a cleaning blade 118 is also provided in the vicinity of the print head 50. The cap 116 serves as a device which prevents the nozzle 51 from drying out, or a device which prevents the viscosity of the ink in the vicinity of the nozzle 51 from increasing. The cleaning blade 118 serves as a device which cleans a nozzle face 88.

A maintenance unit 110 can be relatively moved with respect to the print head 50 by a movement mechanism (not shown), and is moved from a predetermined holding position to a maintenance position below the print head 50 as required.

The cap 116 is displaced up and down relative to the print head 50 by an elevator mechanism (not shown). When the power is turned OFF or during image formation standby, the elevator mechanism raises the cap 116 to a predetermined elevated position so as to attach the cap 116 tightly to the nozzle face 88 of the print head 50, and thus the nozzle face 88 of the print head 50 is covered by the cap 116.

The cleaning blade 118 is composed of an elastic member such as rubber, and is capable of sliding over the lower surface of the nozzle face 88 of the print head 50 by means of a blade moving mechanism (wiper) not shown in the drawing. When an ink droplet or foreign object adheres to the nozzle face 88, the surface of the nozzle face 88 can be wiped clean by sliding the cleaning blade 118 over the nozzle face 88. Incidentally, a preliminary ejection is preferably performed after a cleaning operation in order to prevent foreign matter from being mixed into the nozzle 51 by the cleaning blade 118 during cleaning by the blade mechanism.

Hereinafter, an ink supply operation performed by such the ink supply system will be described.

Firstly, when the power of the inkjet recording apparatus 10 is switched ON for the first time during start-up or the like, the valves B1 and B2 remain open, and both of the pumps P1 and P2 are driven to supply the ink in this state. Therefore, the sub-tank 102 and buffer tanks 104 and 106 are filled with the ink until the ink in the sub-tank 102 and buffer tanks 104 and 106 reaches a predetermined level. Though not shown in the drawing, a separate pump may be used to fill the sub-tank 102.

Next, in order to ensure that the interior of the print head 50 is filled with ink reliably, the valve B1 is left open, the valve B2 is closed, and the pumps P1 and P2 are driven, so that the pump P1 sends the ink while the pump P2 suctions the ink, thereby circulating. Therefore, the ink is circulated.

Next, after a predetermined time period, the valve B1 is closed, the valve B2 is opened, and the pumps P1 and P2 are driven, so that the pump P1 sends the ink while the pump P2 suctions the ink as similar to above. Therefore, the ink is circulated. Accordingly, the interior of the print head 50 is filled with ink, and air bubbles are discharged smoothly without performing a preliminary ejection. Then, the opened valve from among the valves B1 and B2 is closed so that both valves B1 and B2 are closed, and the ink is circulated by driving the pumps P1 and P2 so that the pump P1 sends the ink while the pump P2 suctions the ink.

Next, both of the valves B1 and B2 are opened, and the pumps P1 and P2 are driven as described above to perform a preliminary ejection while circulating the ink. Therefore, ink containing air bubbles is discharged from the nozzle 51. By means of this operation, ink in the pressure chamber 52 that contains air bubbles can be ejected through the nozzle 51. Furthermore, since both of the valves B1 and B2 are open, a refilling operation to replace the discharged ink can be performed smoothly.

Alternatively, an operation may be performed to drive at least one of the pumps P1 and P2 so that the pump P2 is stopped while the pump P1 continues to be driven to send liquid, for example. Therefore, since the ink is supplied while being pressurized, then the ink in the pressure chamber 52 which contains air bubbles can be discharged through the nozzle 51, reliably. Furthermore, since both of the valves B1 and B2 are open, the ink can be supplied to the print head 50 smoothly.

Then, after these operations, the pumps P1 and P2 are stopped. Incidentally, during restoration processing on the nozzle 51, the ink discharged through the nozzle 51 is collected in the cap 116, and is returned to the sub-tank 102 via a collection tank 120.

In FIG. 29, since the ink is supplied from the supply pipes 84 to the print head 50 through the main supply port 85, then the print head 50 is filled with the ink. Since the ink is circulated by this ink filling operation, then the ink can be filled and replaced reliably. Moreover, when the pressure chamber 52 and nozzle 51 are filled with ink, a preliminary ejection is performed from the nozzle 51. Therefore, the ink containing air bubbles can be discharged reliably from the nozzle 51 of the pressure chamber 52.

During image formation, the valves B1 and B2 are open, and the ink is ejected through the nozzle 51 by driving the piezo 58 of the print head 50 in this state. At this time, the pumps P1 and P2 are not driven. Since the main supply pipes 84 are connected to the common liquid chamber in the print head 50, then the ink can be supplied directly to the pressure chamber 52 from the common liquid chamber via the supply restrictor 53. Therefore, the ink can be supplied with stability even during continuous ink ejection operation at a high-speed.

Furthermore, since the ink supply system is constituted as an ink circulation system described above, then the print head 50 can be cooled by the circulating ink even when the piezo 58 generates a large amount of heat during continuous printing or the like.

Moreover, since a voltage which is great enough to cause ejection is applied to the piezo 58, temperature of the print head 50 can be controlled more evenly.

As shown in FIG. 11C, the adhesion grooves 167*b* are provided to stabilize adhesion when the plate members are joined and laminated, for example, but the signal extraction through holes 167*a* may be used as adhesive escape grooves. In this case, first, the adhesive is applied onto the plates, and the plates are bonded. Next, suction is applied to the through holes 167*a* in order to extract the excess adhesive, and then heat is applied in order to cure the adhesive. Then, the through holes 167*a* may be subjected to insulation processing and may be plated so that the conductivity is obtained as similar to the other through holes.

Furthermore, in the examples described above, the print head 50, 150, 250, 350, and 450 is constituted by laminating together stainless steel thin plates, but a portion of the laminated structure may be formed from a material such as resin, silicon, or ceramics.

The liquid ejection head and the image forming apparatus comprising the liquid ejection head of the present invention have been described in detail above, but the present invention is not limited to the above examples, and may be subjected to various improvements and modifications within a scope that does not depart from the spirit of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a plate having a plurality of ejection ports which eject a liquid;

a plurality of pressure chambers which respectively connect to the ejection ports;

a plurality of piezoelectric elements which respectively deform the pressure chambers, the piezoelectric elements being provided on a side of the pressure chambers opposite to a side on which the ejection ports are formed;

a plurality of thin plates formed with a plurality of flow channels for the liquid;

a common liquid chamber which respectively supplies the liquid to the pressure chambers, the common liquid chamber being formed on a side of the piezoelectric elements opposite to a side of the piezoelectric elements that the pressure chambers are formed; and a plurality of electric wires which respectively transfer a drive signal to the piezoelectric elements, the drive signal driving the piezoelectric elements for deforming the pressure chambers, wherein:

the common liquid chamber is a space which is formed by laminating the thin plates together; and the electric wires are formed in opening portions formed in parts of portions on which the laminated thin plates overlap to each other, the electric wires being formed so as to rise upward in a substantially perpendicular direction to a surface on which the piezoelectric elements are disposed.

2. The liquid ejection head as defined in claim 1, wherein a notch structure that the liquid passes through is formed in a part of at least one of the thin plates, the part being between the flow channels.

3. The liquid ejection head as defined in claim 1, wherein a mesh structure that the liquid passes through is formed in a part of at least one of the thin plates, the part being between the flow channels.

4. The liquid ejection head as defined in claim 1, wherein a thin hollow structure is formed in a part of at least one of the thin plates, the part being between the flow channels.

5. The liquid ejection head as defined in claim 1, wherein:

the thin plates are laminated together so that beam portions intersect between the thin plates, the beam portions being made by forming the flow channels on each of the thin plates; and the electric wires are formed respectively in parts at which the beam portions intersect.

6. The liquid ejection head as defined in claim 1, wherein a thin plate formed with the flow channels is laminated onto the piezoelectric elements, the thin plate having a thin structure in a part corresponding to each of the laminated piezoelectric elements.

7. The liquid ejection head as defined in claim 1, wherein:

at least one of recessed form portions and protruding form portions are formed in parts of the thin plates in order to provide the electric wires; and the at least one of the recessed form portions and the protruding form portions make contact with electric connection members.

8. The liquid ejection head as defined in claim 1, wherein driving inspection is performed to the piezoelectric elements in a state that the liquid is filled in the liquid ejection head before the electric wires are installed on a diaphragm on which the piezoelectric elements are disposed.

9. The liquid ejection head as defined in claim 1, wherein:

a heater is provided in a part of the laminated thin plates, the heater controlling temperature in the liquid ejection head by heating; and the temperature in the liquid ejection head is controlled by flowing at least the liquid for ejection into the common liquid chamber when the temperature exceeds a set temperature value.

10. An image forming apparatus, comprising a liquid ejection head which comprises: a plate having a plurality of ejection ports which eject a liquid; a plurality of pressure chambers which respectively connect to the ejection ports; a plurality of piezoelectric elements which respectively deform the pressure chambers, the piezoelectric elements being provided on a side of the pressure chambers opposite to a side on which the ejection ports are formed; a plurality of thin plates formed with a plurality of flow channels for the liquid; a common liquid chamber which respectively supplies the liquid to the pressure chambers, the common liquid chamber being formed on a side of the piezoelectric elements opposite to a side of the piezoelectric elements that the pressure chambers are formed; and a plurality of electric wires which respectively transfer a drive signal to the piezoelectric elements, the drive signal driving the piezoelectric elements for deforming the pressure chambers, wherein:

the common liquid chamber is a space which is formed by laminating the thin plates together; and the electric wires are formed in opening portions formed in parts of portions on which the laminated thin plates overlap to each other, the electric wires being formed so as to rise upward in a substantially perpendicular direction to a surface on which the piezoelectric elements are disposed.

11. The image forming apparatus as defined in claim 10, wherein a notch structure that the liquid passes through is formed in a part of at least one of the thin plates, the part being between the flow channels.

12. The image forming apparatus as defined in claim 10, wherein a mesh structure that the liquid passes through is formed in a part of at least one of the thin plates, the part being between the flow channels.

13. The image forming apparatus as defined in claim 10, wherein a thin hollow structure is formed in a part of at least one of the thin plates, the part being between the flow channels.

14. The image forming apparatus as defined in claim 10, wherein:

the thin plates are laminated together so that beam portions intersect between the thin plates, the beam portions being made by forming the flow channels on each of the thin plates; and the electric wires are formed respectively in parts at which the beam portions intersect.

15. The image forming apparatus as defined in claims 10, wherein a thin plate formed with the flow channels is laminated onto the piezoelectric elements, the thin plate having a thin structure in a part corresponding to each of the laminated piezoelectric elements.

16. The image forming apparatus as defined in claim 10, wherein:

at least one of recessed form portions and protruding form portions are formed in parts of the thin plates in order to provide the electric wires; and the at least one of the recessed form portions and the protruding form portions make contact with electric connection members.

17. The image forming apparatus as defined in claim 10, wherein driving inspection is performed to the piezoelectric elements in a state that the liquid is filled in the liquid ejection head before the electric wires are installed on a diaphragm on which the piezoelectric elements are disposed.

18. The image forming apparatus as defined in claim 10, wherein:

a heater is provided in a part of the laminated thin plates, the heater controlling temperature in the liquid ejection head by heating; and the temperature in the liquid ejection head is controlled by flowing at least the liquid for ejection into the common liquid chamber when the temperature exceeds a set temperature value.

* * * * *